US006015646A

United States Patent [19]

Iwasaki et al.

[11] Patent Number: 6,015,646

[45] Date of Patent: Jan. 18, 2000

[54] ELECTROPHOTOSENSITIVE MATERIAL AND IMAGE FORMING METHOD USING THE SAME

[75] Inventors: Hiroaki Iwasaki; Yukimasa Watanabe; Sakae Saitoh; Shyunichi Matsumoto; Maki Uchida, all of Osaka, Japan

[73] Assignee: Mita Industrial Co., Ltd., Osaka, Japan

[21] Appl. No.: 09/210,612

[22] Filed: Dec. 14, 1998

[30] Foreign Application Priority Data

Dec. 25, 1997 [JP] Japan ..... 9-358633

[51] Int. Cl.[7] ..... G03G 5/09

[52] U.S. Cl. ..... 430/83; 430/73

[58] Field of Search ..... 430/73, 83

[56] References Cited

U.S. PATENT DOCUMENTS

| | | | |
|---|---|---|---|
| 5,213,926 | 5/1993 | Hanatani et al. | 430/83 |
| 5,334,470 | 8/1994 | Shimada et al. | 430/83 |
| 5,494,765 | 2/1996 | Fukami et al. | 430/83 |

FOREIGN PATENT DOCUMENTS

| | | |
|---|---|---|
| 1-142642 | 6/1989 | Japan . |
| 3-261958 | 2/1990 | Japan . |
| 2-36269 | 11/1991 | Japan . |
| 5-105647 | 4/1993 | Japan . |
| 5-88389 | 4/1993 | Japan . |
| 7-72634 | 3/1995 | Japan . |
| 7-324058 | 12/1995 | Japan . |
| 8-9579 | 1/1996 | Japan . |

OTHER PUBLICATIONS

Database WPI, Section ch. Week 9012, Class E14, An 90–085939, Derwent Publications Ltd., London, GB.

Database WPI, Section ch. Week 9321, Class E14, An 93–172642, Derwent Publications ltd., London, GB.

Chemical Abstracts, vol. 123, No. 2, p. 949, Jul. 10, 1995, Columbus, Ohio, U.S.A.

*Primary Examiner*—Roland Martin

*Attorney, Agent, or Firm*—Smith, Gambrell & Russell, LLP

[57] ABSTRACT

The present invention provides an electrophotosensitive material comprising a photosensitive layer containing a m-phenylenediamine compound represented by the general formula (1):

(1)

wherein $R^{1A}$ and $R^{1B}$ are the same or different and indicate an alkyl group; and $R^{1C}$, $R^{1D}$, $R^{1E}$ and $R^{1F}$ are the same or different and indicate a hydrogen atom or an alkyl group, which has high sensitivity and issuperior in stability to strong light, durability and heat resistance, and an image forming method capable of realizing more higher speed and more larger energy saving than the prior art.

10 Claims, 1 Drawing Sheet

ELECTROPHOTOSENSITIVE MATERIAL AND IMAGE FORMING METHOD USING THE SAME

BACKGROUND OF THE INVENTION

The present invention relates to an electrophotosensitive material which is used in image forming apparatuses utilizing a so-called electrophotographic process, such as electrostatic copying machine, plane paper facsimile, laser-printer and the like, and an image forming method using the same.

Recently, there have widely been used a so-called organic photoconductor (OPC) such as a photoconductor comprising a single-layer type photosensitive layer obtained by dispersing an electric charge generating material capable of generating electric charges (holes and electrons) by light irradiation and an electric charge transferring material capable of transferring the generate electric charges in a single layer made of a binding resin, or a photoconductor comprising a multi-layer type photosensitive layer obtained by laminating an electric charge transferring layer containing an electric charge transferring material and an electric charge generating layer containing an electric charge generating material, as the above electrophotosensitive material.

Such an organic photoconductor has advantages such as easier production than an inorganic photoconductor using a deposited film made of an inorganic semiconductor material, various selective photosensitive materials (e.g. electric charge generating material, electric charge transferring material, binding resin, etc.) and high rate of freedom with functional design.

Examples of the electric charge transferring material a include hole transferring material having excellent transferring capability of holes and electron transferring material having excellent transferring capability of electrons. As the hole transferring material, various organic compounds such as carbazole compound, oxadiazole compound, pyrazoline compound, phenylenediamine compound, benzidine compound and the like are known.

Among them, a m-phenylenediamine compound represented by the general formula (2):

(2)

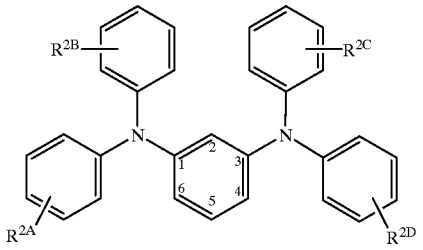

wherein $R^{2A}$, $R^{2B}$, $R^{2C}$ and $R^{2D}$ are the same or differentand indicate a hydrogen atom, an alkyl group, an alkoxy group or an aryl group has widely been used, particularly, because of its excellent characteristics as described below.

That is the m-phenylenediamine compound (2) has the following advantages. That is, the transferring capability of holes is excellent because of large drift mobility, which indicates thetransferring capability of holes, and a residual potential is liable to be drawn at low electric field because dependence of the drift mobility on an field intensity is small. Furthermore, the m-phenylenediamine compound is superior in compatibility with a binding resin constituting the electric charge transferring layer and also has light resistance to some extent to ultraviolet light.

However, a photoconductor using the m-phenylenediamine compound (2) had such a problem that unrestorable damage is caused by exposing to a fluorescent lamp for interior illumination or strong light such as sunlight coming into a room through a window in the state where the body of an image forming device is opened for a long time in case of maintenance, or by exposing to strong light described above in the high-temperature state in case of operation even for a short time when the body is opened because paper jam occurs during the operation of the device.

This reason is considered as follows. That is, a photodeterioration reaction occurs by exposing to strong light described above, specifically a cyclization between a central benzene ring and the other phenyl group, thereby changing the m-phenylenediamine compound (2) into impurities as a trap to transfer of holes.

That is, the density of electrons of the m-phenylenediamine compound (2) is biased against the benzene ring in the molecular center and the compound has such a molecular structure that carbon at the 5-position of above benzene ring is likely to be attacked by an oxidizing substance such as oxygen in case of light excitation because of its configuration. Therefore, it is considered that the above cyclization reaction can occur by drawing electrons from the carbon at the 5-position of above benzine ring.

Further, since a melting point of the m-phenylenediamine compound (2) is generally low, a photosensitive layer obtained by using the compound has a low glass transition temperature and is insufficient in durability and heat resistance. Particularly, when the device stops in the high-temperature state in case of the operation and is allowed to stand for a long time, an impression due to a cleaning blade appears as a striped concave portion on the surface of the photosensitive layer, which can causes image defects.

Therefore, in order to solve these problems, there have been suggested a m-phenylenediamine compound wherein the durability to strong light exposure is improved by substituting a group such as alkyl group on the 5-position of the central benzene ring as shown in the general formula (3) below, and an electrophotosensitive material using the same (Japanese Examined Patent Publication No. 9579/1996).

(3)

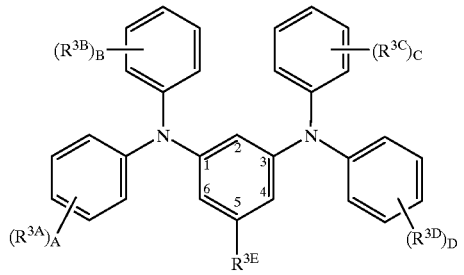

wherein $R^{3A}$, $R^{3B}$, $R^{3C}$ and $R^{3D}$ are the same or different and indicate an alkyl group, an alkoxy group, a halogen atom, an amino group or a N-substituted amino group; A, B, C and D are the same or different and indicate an integer of 0 to 5; and $R^{3E}$ indicates an alkyl group, an alkoxy group, an amino group, an allyl group or an aryl group.

Since such a m-phenylenediamine compound (3) has characteristics peculiar to a conventional m-phenylenediamine compound (2) described above and has high durability to strong light exposure, it is expected that the performance of the organic electrophotosensitive material can be more improved than the prior art.

Further, especially, a compound, wherein an aryl group such as phenyl group is substituted as the above group $R^{3E}$, has a particularly high melting point and, therefore, it is expected that the durability and heat resistance can be improved by rising of the glass transition temperature of the photosensitive layer.

However, in order to satisfy increasing requirements such as realization of more higher speed and much larger energy saving of the image forming device, the sensitivity of an electrophotosensitive material using a conventional hole transferring material including the above m-phenylenediamine compound (3) has already becoming insufficient at present. Therefore, it has been required to develop a novel hole transferring material capable of forming an electrophotosensitive material having a higher sensitivity.

SUMMARY OF THE INVENTION

It is a main object of the present invention to provide an electrophotosensitive material which has a photosensitive layer not only having particularly high sensitivity and being able to sufficiently cope with the requirements such as realization of muchhigher speed and much larger energy saving of the image forming device, but also having excellent stability to strong light, durability and heat resistance.

It is another object of the present invention to provide an image forming method using such an electrophotosensitive material, capable of realizing much higher speed and much larger energy saving.

In order to accomplish the above objects, the present inventors have studied intensively to improve the molecular structure, particularly kind and position of substituents, of the above m-phenylenediamine compound (3).

As a result, they have found that, by containing a m-phenylenediamine compound represented by the following general formula (1):

(1)

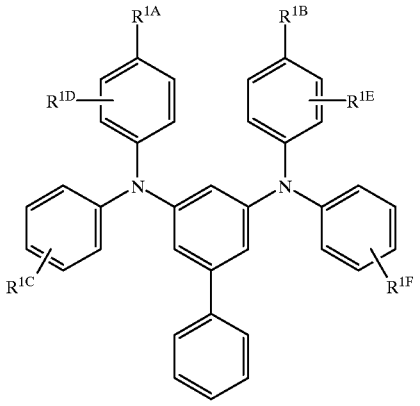

wherein $R^{1A}$ and $R^{1B}$ are the same or different and indicate an alkyl group; and $R^{1C}$, $R^{1D}$, $R^{1E}$ and $R^{1F}$ are the same ordifferent and indicate a hydrogen atom or an alkyl group], which is substantially included in the scope of the general formula (3) but is not specifically disclosed in the above publication of the prior application (Japanese Examined Patent Publication No. 9579/1996), in a photosensitive layer as the hole transferring material, the sensitivity of the electrophotosensitive material is remarkably improved while maintaining excellent characteristics of the m-phenylenediamine compound (3) such as stability to strong light, durability and heat resistance and, therefore, an electrophotosensitive material having a sufficient sensitivity can be obtained even if it is used in an image forming device capable of realizing high speed and energy saving, wherein a light exposure to the photosensitive material is not more than 0.54 mW/cm$^2$ and an exposure time is not more than 25 msec., for example.

The electrophotosensitive material of the present invention comprises a photosensitive layer containing a m-phenylenediamine compound represented by the above general formula (1).

Further, an image forming method of the present invention, which comprises the steps of uniformly charging the surface of an electrophotosensitive material of the present invention and exposing to light under the conditions of an light exposure of not more than 0.54 mW/cm$^2$ and an exposure time of not more than 25 msec to form an electrostatic latent image on the surface.

DETAILED DESCRIPTION OF THE INVENTION

Figure 1:
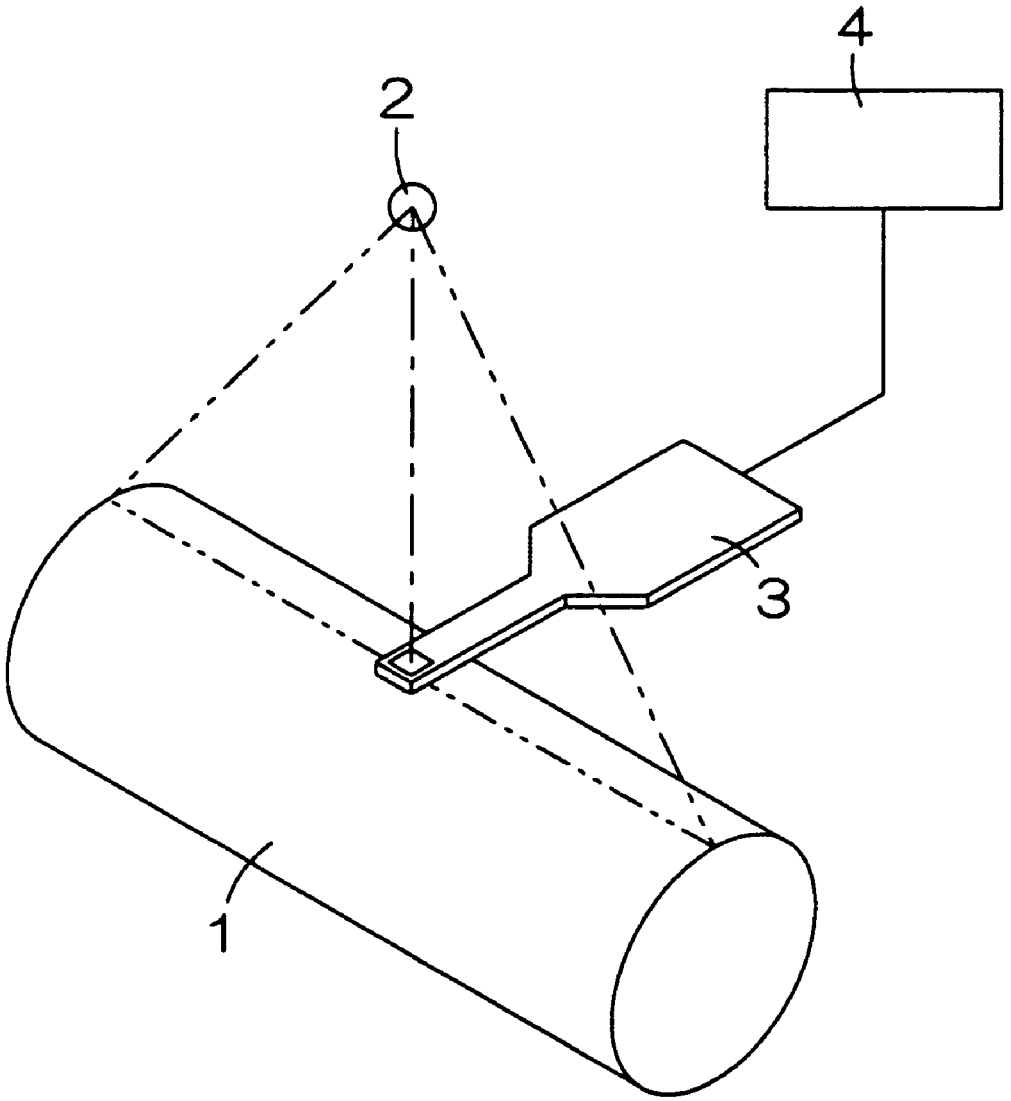
FIG. 1 is perspective view showing one embodiment of a method of measuring an light exposure to the electrophotosensitive material.

The present invention will be described in detail thereinafter.

The electrophotosensitive material of the present invention is characterized by providing a photosensitive layer containing the above m-phenylenediamine compound (1) on a conductive substrate.

The m-phenylenediamine compound (1) is different from the previous compound (3) in that the substituent to be substituted on the 5-position of the central benzene ring is limited to a phenyl group and, at the same time, the substitution position of the groups $R^{1A}$ and $R^{1B}$ is respectively limited to the 4-position of two phenyl groups combined with the above central benzene ring through a nitrogen atom.

The compound (1) thus limited is substantially included in the scope of the previous compound (3), however, the above publication of the prior application does not disclose specifically such a compound (1).

For example, in the table in page 3–4 of the publication of the prior application, there is described some compounds wherein the substituent $R^{3E}$ ($R^5$ in the publication) as phenyl group to be substituted on the 5-position of the central benzene ring. And, the compounds do not describe about the substitution position of the other substituents $R^{3A}$ to $R^{3D}$ ($R^1$ to $R^4$ in the publication)

However, in the first to fourth Synthesis Examples corresponding to the Examples of the publication of the prior application as well as Comparative Example, the substitution position of all substituents $R^{3A}$ to $R^{3D}$ is specified to the 3-position of the phenyl group. Consequently, it is assumed that the substitution position of all substituents $R^{3A}$ to $R^{3D}$ in the respective compounds in the above table is specified to the 3-position.

Therefore, the m-phenylenediamine compound (1) used in the present invention is not disclosed in the compounds disclosed specifically in the publication of the prior application.

The alkyl group corresponding to the groups $R^{1A}$ to $R^{1F}$ in the general formula (1) includes, for example, an alkyl group having 1 to 6 carbon atoms, such as methyl, ethyl, normal propyl, isopropyl, normal butyl, isobutyl, sec-butyl, tert-butyl, pentyl, hexyl or the like. An alkyl group having 1 to 4 carbon atoms, particularly three kinds of alkyl groups such as methyl, isopropyl and normal butyl, may be preferably used.

A specific compound of the m-phenylenediamine compound (1) includes, for example, compounds (1-1) to (1-11) wherein each kind and each substitution position of the groups $R^{1A}$ to $R^{1F}$ in the formula (1) are as shown in Table 1, but is not limited thereto.

TABLE 1

| Compound No. | $R^{1A}$ | $R^{1B}$ | $R^{1C}$ | $R^{1D}$ | $R^{1E}$ | $R^{1F}$ |
|---|---|---|---|---|---|---|
| 1-1 | Me | Me | H | H | H | H |
| 1-2 | Me | Me | 3-Me | H | H | 3-Me |
| 1-3 | Me | Me | 4-Me | 3-Me | 3-Me | 4-Me |
| 1-4 | Me | Me | 3-Me | 3-Me | 3-Me | 3-Me |
| 1-5 | Me | Me | 4-iPr | H | H | 4-iPr |
| 1-6 | Me | Me | 4-iPr | 3-Me | 3-Me | 4-iPr |
| 1-7 | iPr | iPr | H | H | H | H |
| 1-8 | Me | Me | 4-nBu | H | H | 4-nBu |
| 1-9 | Me | Me | 4-nBu | 3-Me | 3-Me | 4-nBu |
| 1-10 | nBu | nBu | 3-Me | H | H | 3-Me |
| 1-11 | nBu | nBu | H | H | H | H |

In the above table, abbreviations in each column of $R^{1A}$ and $R^{1B}$ mean the following substituents.

Me: methyl iPr: isopropyl nBu: normal butyl

In the above table, abbreviations in each column of $R^{1C}$ to $R^{1F}$ mean the following substituents.

H: hydrogen atom

3-Me: methyl substituted on the 3-position of phenyl group

4-Me: methyl substituted on the 4-position of phenyl group 4-iPr: isopropyl substituted on the 4-position of phenyl group 4-nBu: normal butyl substituted on the 4-position of phenyl group Each position at which $R^{1C}$ to $R^{2F}$ are substituted on the phenyl group is a position represented by each small numeral in the following general formula (1).

(1)

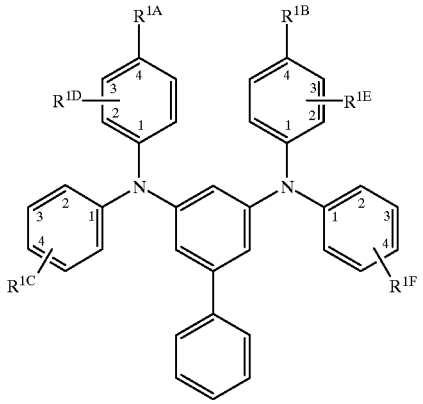

The specific structure of each compound shown in Table 1 will be shown below.

(1-1)

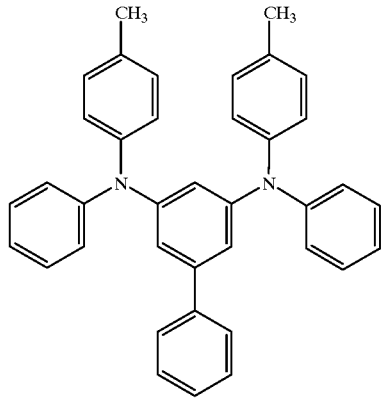

(1-2)

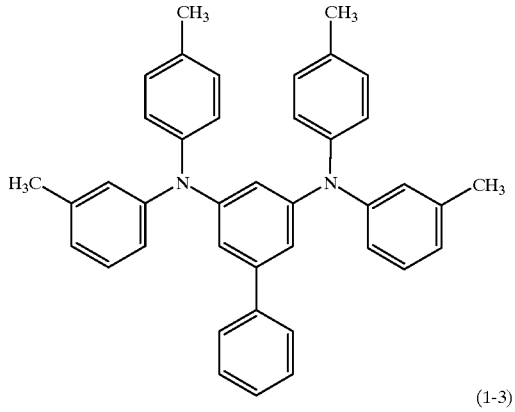

(1-3)

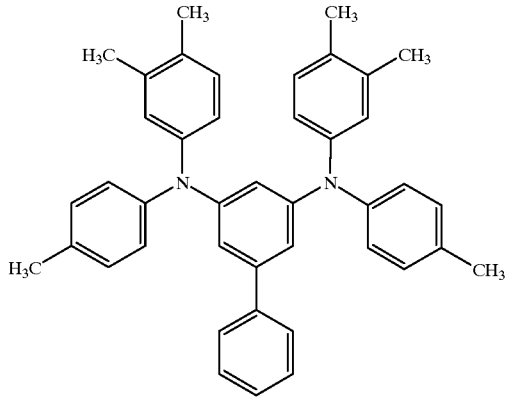

(1-4)

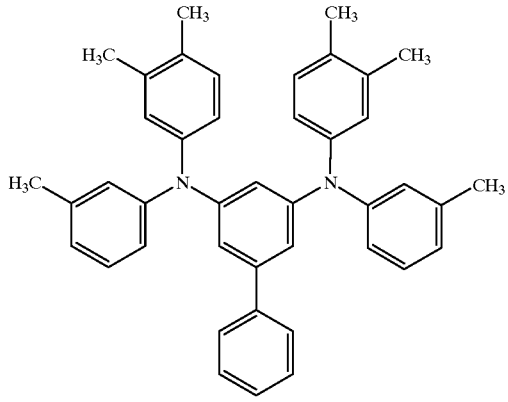

-continued
(1-5)
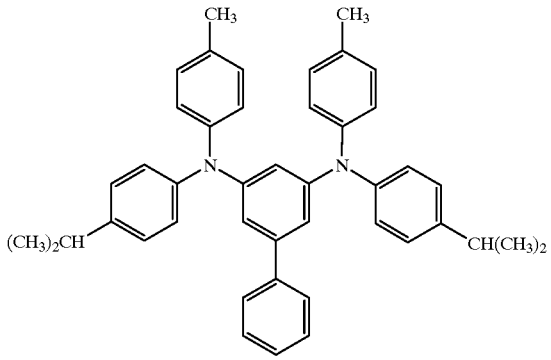
(1-6)
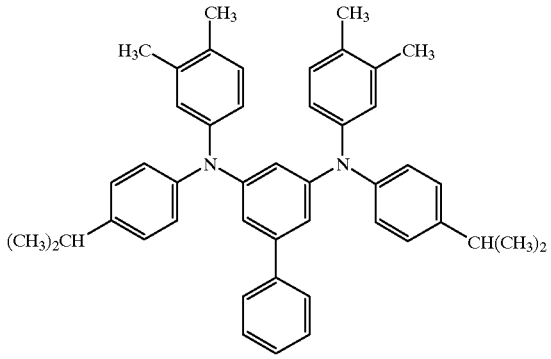
(1-1)
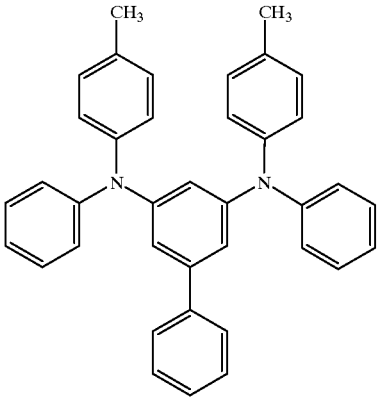
(1-2)
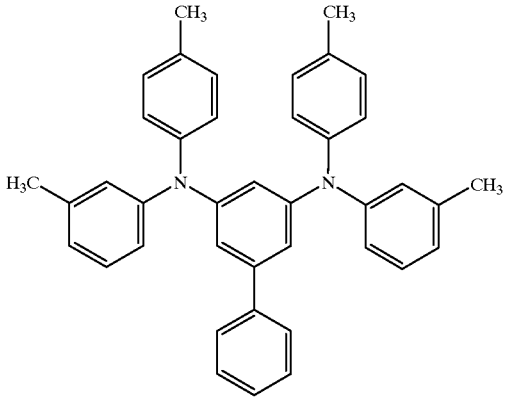
-continued
(1-3)
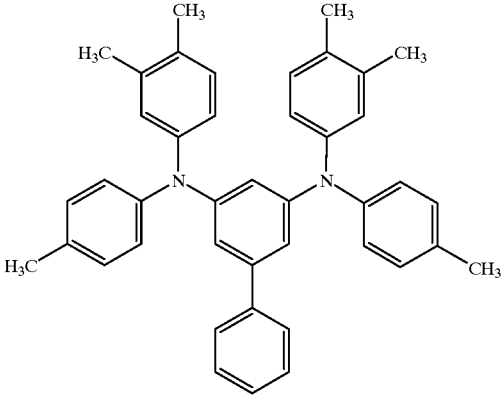
(1-4)
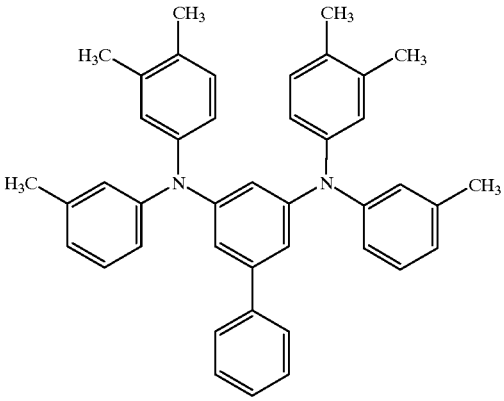
(1-5)
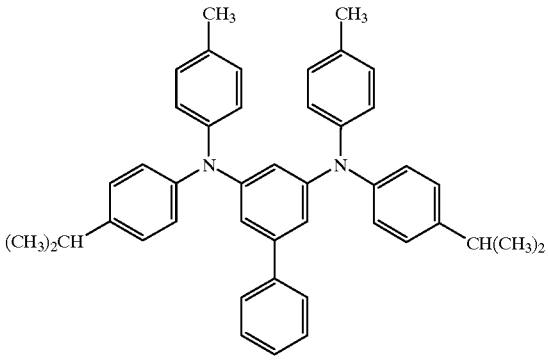
(1-6)
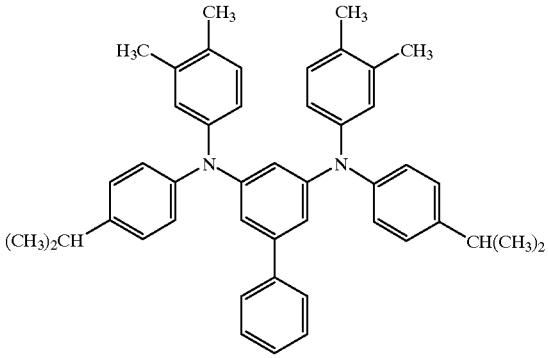

-continued (1-7)

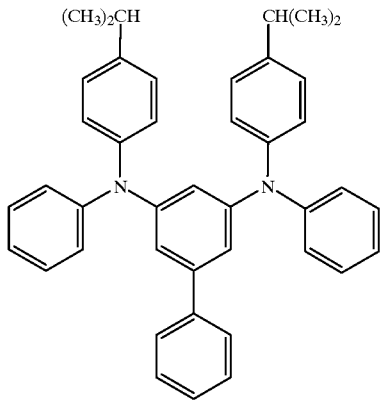

(1-8)

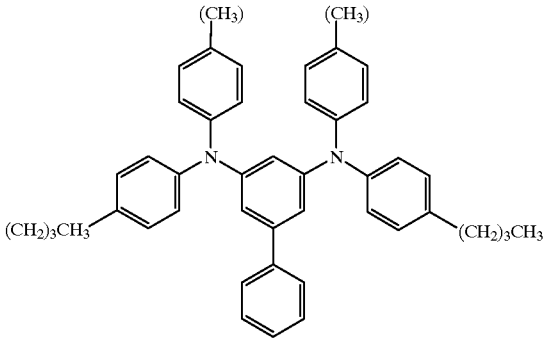

(1-9)

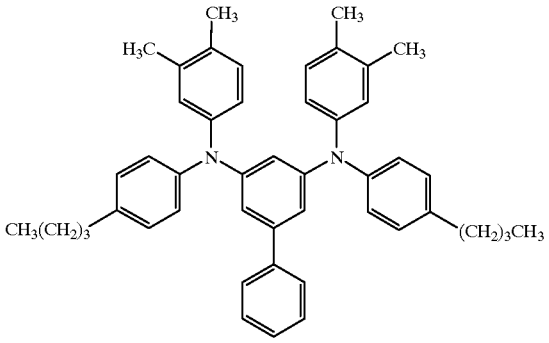

(1-10)

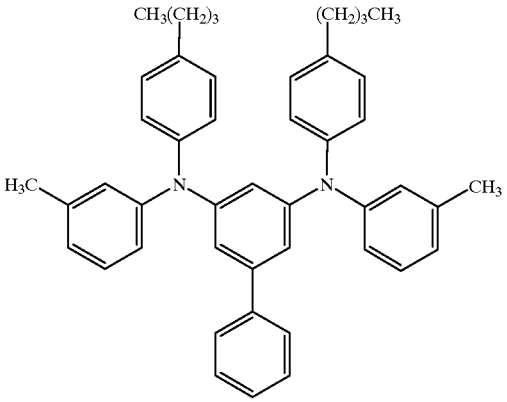

-continued (1-11)

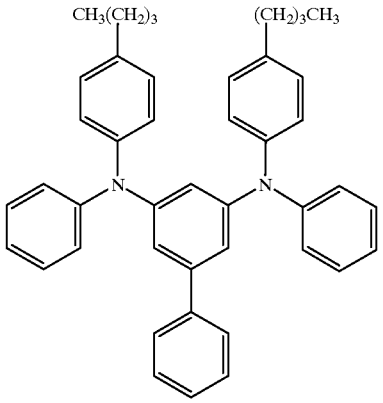

Among the above m-phenylenediamine compound (1), a compound wherein the groups $R^{1A}$ and $R^{1B}$ are respectively an alkyl group having 1 to 4 carbon atoms, the groups $R^{1C}$ and $R^{1F}$ are respectively an alkyl group having 1 to 4 carbon atoms substitute on the 3- or 4-position of a phenyl group and the groups $R^{1D}$ and $R^{1E}$ are respectively a hydrogen atom, particularly a compound wherein the alkyl group corresponding to the groups $R_{1A}$, $R^{1B}$, $R^{1C}$ and $R^{1F}$ is a methyl, an isopropyl or a normal butyl, is particularly superior in the above-described characteristics as is apparent from the results of the Examples described hereinafter and, therefore, it is preferably used in the present invention. The compound satisfying these conditions include, for example, compounds (1-2), (1-5), (1-8) and (1-10).

As the photosensitive layer containing the above m-phenylenediamine compound (1), any construction of so-called single-layer type and multi-layer type photosensitive layers may be employed.

The single-layer type photosensitive layer is characterized by containing the m-phenylenediamine compound (1) as the hole transferring material in a binding resin, together with an electric charge generating material. Such a single-layer type photosensitive layer is capable of coping with any of positive and negative charging using a single construction, and has simple layer construction and is superior in productivity.

The single-layer type photosensitive layer can contain an organic electron transferring material having an excellent electron transferring capability in addition to the above respective components. Such a photosensitive layer does not cause an interaction between the m-phenylenediamine compound (1) and electron transferring material and, therefore, the sensitivity is much higher.

That is, even if both transferring materials are contained in the same layer in a high concentration at which transfer of holes and electrons occurs efficiently, an electric charge transfer complex, which does not contribute to transfer of holes and electrons in the layer, is not formed. Therefore, the m-phenylenediamine compound (1) as the hole transferring material can efficiently transfer holes, whereas, the electron transferring material can efficiently transfer electrons. As a result, the residual potential of the electrophotosensitive material is drastically lowered and the sensitivity is improved.

On the other hand, the multi-layer type photosensitive layer comprises an electric charge generating layer containing an electric charge generating material and an electric charge transferring layer containing an electric charge transferring material on a conductive substrate. The order of forming both layers may be optional.

However, the film thickness of the electric charge generating layer is thinner than that of the electric charge transferring layer. Therefore, for protecting the electric charge generating layer, the electric charge generating layer is preferably formed on the conductive substrate and the electric charge transferring layer is formed thereon.

Depending on the order of forming the electric charge generating layer and electric charge transferring layer and kind of the electric charge transferring material (hole transferring material or electron transferring material) used in the electric charge transferring layer, it is decided whether the multi-layer type photosensitive layer becomes a positive or negative charging type.

For example, when the m-phenylenediamine compound (1), which is the hole transferring material, is used as the electric charge transferring material of the electric charge transferring layer in the multi-layer type photosensitive layer obtained by forming the electric charge generating layer on the conductive substrate and forming the electric charge transferring layer thereon, the resulting photosensitive layer becomes a negative charging type. In this case, when the electron transferring material is contained in the electric charge generating layer, the sensitivity is further improved.

When the electron transferring material is used as the electric charge transferring material of the electric charge transferring layer in the multi-layer type photosensitive layer with the above layer construction, the resulting photosensitive layer becomes a positive charging type. In this case, the m-phenylenediamine compound (1) as the hole transferring material may be contained in the electric charge generating layer.

The electric charge generating material, electron transferring material, hole transferring material and binding resin used in the electrophotosensitive material of the present invention are as follows.

<Electric charge generating material>

Examples of the electric charge generating material include compounds represented by the following general formulas (CG1) to (CG12):

(CGI) Metal-free phthalocyanine (CG1)

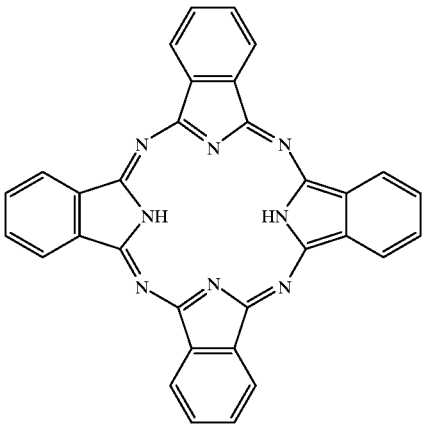

(CG2) Oxotitanyl phthalocyanine (CG2)

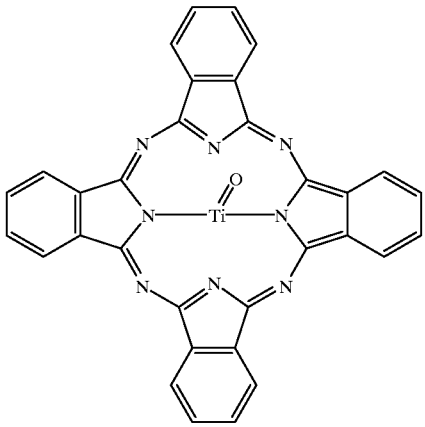

(CG3) Perylene pigment (CG3)

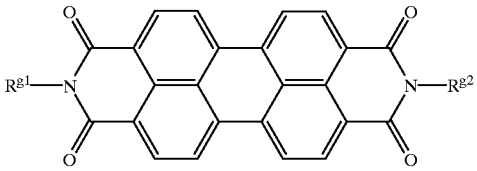

wherein $R^{g1}$ and $R^{g2}$ are the same or different and represent a substituted or non-substituted alkyl group having 18 or less carbon atoms, a cycloalkyl group, an aryl group, an alkanoyl group or an aralkyl group;

(CG4) Bisazo pigment $$Cp^1—N=N—Q—N=N—Cp^2 \quad (CG4)$$

wherein $Cp^1$ and $Cp^2$ are the same or different and represent a coupler residue; and Q represents a group represented by the following formulas (Q-1) to (Q-8):

(Q-1)

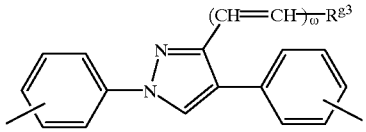

(wherein $R^{g3}$ represents a hydrogen atom, an alkyl group, an aryl group or a heterocyclic group, and the alkyl group, aryl group or heterocyclic group may have a substituent; and ω represents 0 or 1);

(Q-2)

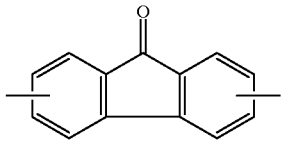

(Q-3)

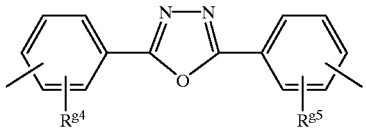

(wherein $R^{g4}$ and $R^{g5}$ are the same or different and represents a hydrogen atom, an alkyl group having 1 to 5 carbon atoms, a halogen atom, an alkoxy group, an aryl group or an aralkyl group);

(Q-4)

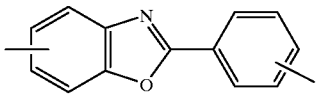

(Q-5)

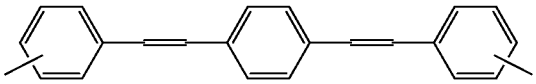

(Q-6)

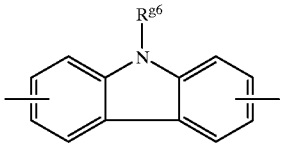

(wherein $R^{g6}$ represents a hydrogen atom, an ethyl group, a chloroethyl group or a hydroxyethyl group);

(Q-7)

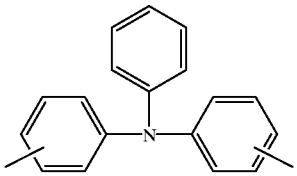

-continued (Q-8)

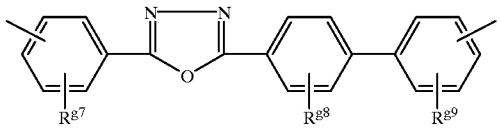

(wherein $R^{g7}$, $R^{g8}$ and $R^{g9}$ are the same or different and represent a hydrogen atom, an alkyl group having 1 to 5 carbon atoms, a halogen atom, an alkoxy group, an aryl group or an aralkyl group)

(CG5) Dithioketopyrrolopyrrole pigment (CG5)

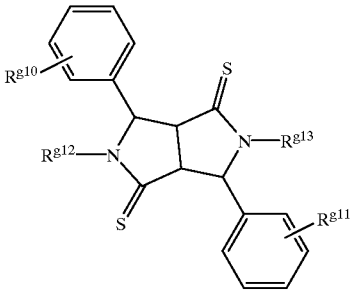

wherein $R^{g10}$ and $R^{g11}$ are the same or different and represent a hydrogen atom, an alkyl group, an alkoxy group or a halogen atom; and $R^{g12}$ and $R^{g13}$ are the same or different and represent a hydrogen atom, an alkyl group or an aryl group;

(CG6) Metal-free naphthalocyanine pigment (CG6)

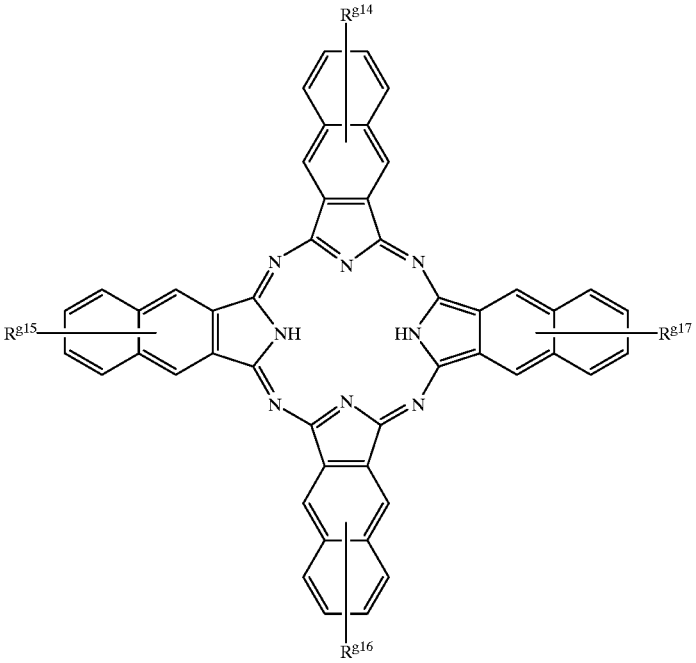

wherein $R^{g14}$, $R^{g15}$, $R^{g16}$, and $R^{g17}$ are the same or different and represent a hydrogen atom, an alkoxy group or a halogen atom;

(CG7) Metal naphthalocyanine pigment (CG7)

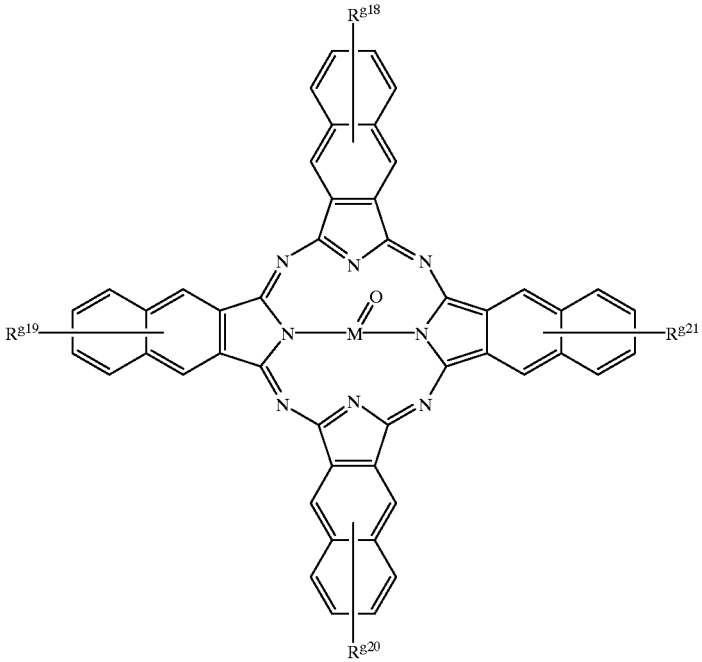

wherein $R^{g18}$, $R^{g19}$, $R^{g20}$ and $R^{g21}$ are the same or different and represent a hydrogen atom, an alkyl group, an alkoxy group or a halogen atom; and M represents Ti or V;

(CG8) Squaline pigment (CG8)

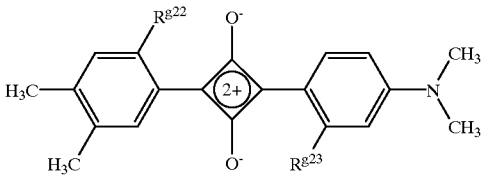

wherein $R^{g22}$ and $R^{g23}$ are the same or different and represent a hydrogen atom, an alkyl group, an alkoxy group or a halogen atom;

(CG9) Trisazo pigment (CG9)

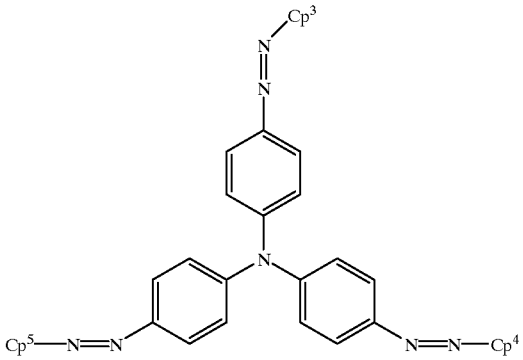

wherein $Cp^3$, $Cp^4$ and $Cp^5$ are the same or different and represent a coupler residue;

(CG10) Indigo pigment (CG10)

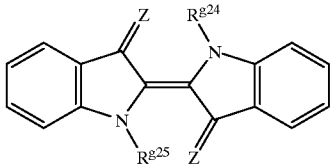

wherein $R^{g24}$ and $R^{g25}$ are the same or different and represent a hydrogen atom, an alkyl group or an aryl group; and Z is an oxygen atom or a sulfur atom;

(CG11) Azulenium pigment (CG11)

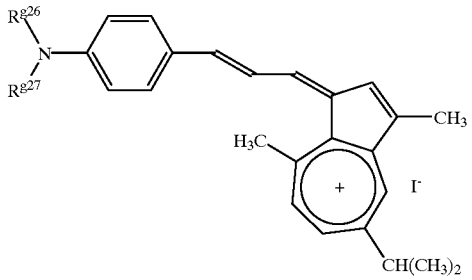

wherein $R^{g26}$ and $R^{g27}$ are the same or different and represent a hydrogen atom, an alkyl group or an aryl group; and (CG12) Cyanine pigment (CG12)

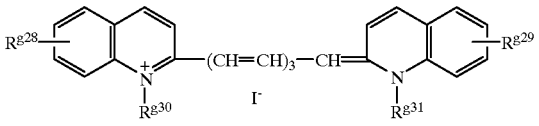

wherein $R^{g28}$ and $R^{g29}$ are the same or different and represent a hydrogen atom, an alkyl group, an alkoxy group or a halogen atom; and $R^{g30}$ and $R^{g31}$ are the same or different and represent a hydrogen atom, an alkyl group or an aryl group.

In the above electron charge generating material, examples of the alkyl group include the same groups as those described above.

Examples of the alkyl group include substituted or non-substituted alkyl groups having 18 or less carbon atoms, such as octyl, nonyl, decyl, dodecyl, tridecyl, pentadecyl, octadecyl, etc., in addition to the above alkyl groups having 1 to 6 carbon atoms.

Examples of the cycloalkyl group include groups having 3 to 8 carbon atoms, such as cyclopropyl, cyclobutyl, cyclopentyl, cyclohexyl, cycloheptyl, cyclooctyl and the like.

Examples of the alkoxy group include groups having 1 to 6 carbon atoms, such as methoxy, ethoxy, n-propoxy, isopropoxy, n-butoxy, isobutoxy, s-butoxy, t-butoxy, pentyloxy, hexyloxy and the like.

Examples of the aryl group include groups such as phenyl, tolyl, xylyl, naphthyl, anthryl, phenanthryl, fluorenyl, bi-phenylyl, o-terphenyl and the like.

Examples of the aralkyl group include groups such as benzyl, benzyhydryl, trityl, phenethyl and the like.

Examples of the alkanoyl group include groups such as formyl, acetyl, propionyl, butyryl, pentanoyl, hexanoly and the like. Examples of the heterocyclic group include thienyl, furyl, pyrrolyl, pyrrolidinyl, oxazolyl, isooxazolyl, thiazolyl, iso-thiazolyl, imidazolyl, 2H-imidazolyl, pyrazolyl, triazolyl, tetrazolyl, pyranyl, pyridyl, piperidyl, piperidino, 3-morpholinyl, morpholino, thiazolyl and the like. In addition, it may be a heterocyclic group condensed with an aromatic ring.

Examples of the substituent which may be substituted on the groups include halogen atom, amino group, hydroxyl group, optionally esterified carboxyl group, cyano group, alkyl group having 1 to 6 carbon atoms, alkoxy group having 1 to 6 carbon atoms, alkenyl group having 2 to 6 carbon atoms which may have an aryl group, etc.

Examples of the halogen atom include fluorine, chlorine, bromine and iodine.

Examples of the coupler residue represented by $Cp^1$, $Cp^2$, $Cp^3$, $Cp^4$ and $Cp^5$ include the groups shown in the following formulas (Cp-1) to (Cp-11).

(Cp-1)

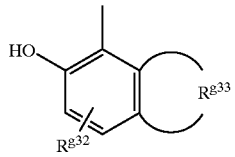

(Cp-2)

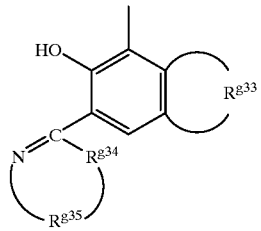

(Cp-3)

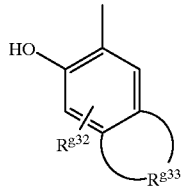

(Cp-4)

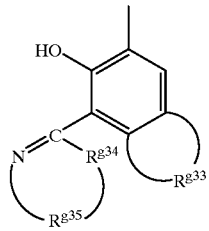

(Cp-5)

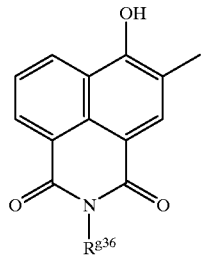

-continued (Cp-6)

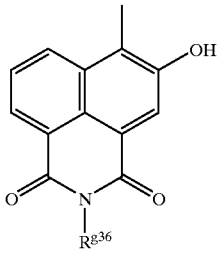

(Cp-7)

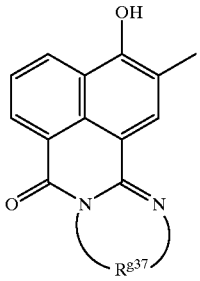

(Cp-8)

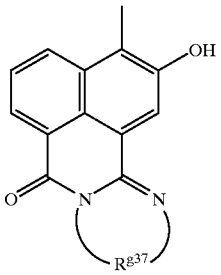

(Cp-9)

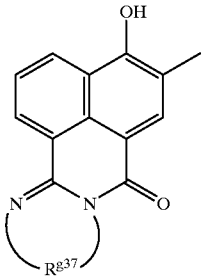

(Cp-10)

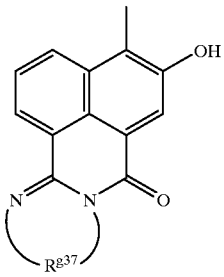

-continued (Cp-11)

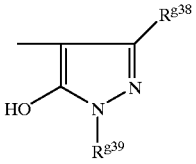

In the respective formulas, $R^{g32}$ is a carbamoyl group, a sulfamoyl group, an allophanoyl group, oxamoyl group, anthranyloyl group, carbazoyl group, glycyl group, hydantoyl group, phthalamoyl group or a succinamoyl group. These groups may have substituents such as halogen atom, phenyl group which may have a substituent, naphthyl group which may have a substituent, nitro group, cyano group, alkyl group, alkenyl group, carbonyl group, carboxyl group and the like.

$R^{g33}$ is an atomic group which is required to form an aromatic ring; apolycyclic hydrocarbon or a heterocycle by condensing with a benzene ring, and these rings may have the same substituents as that described above.

$R^{g34}$ is an oxygen atom, a sulfur atom or an imino group.

$R^{g35}$ is a divalent chain hydrocarbon or aromatic hydrocarbon group, and these groups may have the same substituents as that described above.

$R^{g36}$ is an alkyl group, an aralkyl group, an aryl group or a heterocyclic group, and these groups may have the same substituents as that described above.

$R^{g37}$ is an atomic group which is required to form a heterocycle, together with a divalent chain hydrocarbon or aromatic hydrocarbon group, or two nitrogen atoms in the above formulas (Cp-1) to (Cp-11), and these rings may have the same substituents as that described above.

$R^{g38}$ is a hydrogen atom, an alkyl group, an amino group, a carbamoyl group, a sulfamoyl group, an allophanoyl group, a carboxyl group, an alkoxycarbonyl group, an aryl group or a cyano group, and the groups other than a hydrogen atom may have the same substituents as that described above.

$R^{g39}$ is an alkyl group or an aryl group, and these groups may have the same substituents as that described above.

Examples of the alkenyl group include alkenyl groups having 2 to 6 carbon atoms, such as vinyl, allyl, 2-butenyl, 3-butenyl, 1-methylallyl, 2-pentenyl, 2-hexenyl and the like.

In the above $R^{g33}$, examples of the atomic group which is required to form an aromatic ring by condensing with a benzene ring include alkylene groups having 1 to 4 carbon atoms, such as methylene, ethylene, trimethylene, tetramethylene and the like.

Examples of the aromatic ring to be formed by condensing the above $R^{g33}$ with a benzene ring include naphthalene ring, anthracene ring, phenanthrene ring, pyrene ring, chrysene ring, naphthacene ring and the like.

In the above $R^{g33}$, examples of the atomic group which is required to form a polycyclic hydrocarbon by condensing with a benzene ring include the above alkylene groups having 1 to 4 carbon atoms, or carbazole ring, benzocarbazole ring, dibenzofuran ring and the like.

In the above $R^{g33}$, examples of the atomic group which is required to form a heterocycle by condensing with a benzene ring include benzofuranyl, benzothiophenyl, indolyl, 1H-indolyl, benzoxazolyl, benzothiazolyl, 1H-indadolyl, benzoimidazolyl, chromenyl, chromanyl, isochromanyl, quinolinyl, isoquinolinyl, cinnolinyl, phthalazinyl, quinazolinyl, quinoxalinyl, dibenzofranyl, carbazolyl, xanthenyl, acridinyl, phenanthridinyl, phenazinyl, phenoxazinyl, thianthrenyl and the like.

Examples of the aromatic heterocyclic group to be formed by condensing the above $R^{g33}$ and the benzene ring include thienyl, furyl, pyrrolyl, oxazolyl, isoxazolyl, thiazolyl, isothiazolyl, imidazolyl, pyrazolyl, triazolyl, tetrazolyl, pyridyl, thiazolyl and the like. In addition, it may also be a heterocyclic group condensed with other aromatic rings (e.g. benzofuranyl, benzoimidazolyl, benzoxazolyl, benzothiazolyl, quinolyl, etc.)

In the above $R^{g35}$ and $R^{g37}$, examples of the divalent chain hydrocarbon include ethylene, trimethylene, tetramethylene and the like. Examples of the divalent aromatic hydrocarbon include phenylene, naphthylene, phenanthrylene and the like.

In the above $R^{g36}$, examples of the heterocyclic group include pyridyl, pyrazyl, thienyl, pyranyl, indolyl and the like.

In the above $R^{g37}$ examples of the atomic group which is required to form a heterocycle, together with two nitrogen atoms, include phenylene, naphthylene, phenanthrylene, ethylene, trimethylene, tetramethylene and the like.

Examples of the aromatic heterocyclic group to be formed by the above $R^{g37}$ and two nitrogen atoms include benzoimidazole, benzo[f]benzoimidazole, dibenzo[e,g] benzoimidazole, benzopyrimidine and the like. These groups may respectively have the same group as that described above.

In the above $R^{g38}$, examples of the alkoxycarbonyl group include methoxycarbonyl, ethoxycarbonyl, propoxycarbonyl, butoxycarbonyl and the like.

In the present invention, there can be used powders of inorganic photoconductive materials such as selenium, selenium-tellurium, selenium-arsenic, cadmium sulfide, amorphous silicon, etc. and electric charge generating materials, which have hitherto been known, such as pyrilium salt, anthanthrone pigments, triphenylmethane pigments, threne pigments, toluidine pigments, pyrazoline pigments, quinacridone pigments, etc., in addition to the above electric charge generating materials.

The above electric charge generating materials can be used alone or in combination thereof to present an absorption wavelength within a desired range.

Among the above electric charge generating materials, a photosensitive material having sensitivity at the wavelength range of 700 nm or more is required in digital-optical image forming apparatuses such as laser beam printer facsimile which used a light source of semiconductor laser, etc. Therefore, phthalocyanine pigments such as metal-free phthalocyanine represented by the above formula (CG1), oxotitanyl phthalocyanine represented by the formula (CG2), etc. are preferably used. The crystal form of the above phthalocyanine pigments is not specifically limited, and various phthalocyanine pigments having different crystal form can be used.

In analogue-optical image forming apparatuses such as electrostatic copying machine using a white light source such as halogen lamp, etc., a photosensitive material having sensitivity at the visible range is required. Therefore, for example, the perylene pigment represented by the above general formula (CG3) and bisazo pigment represented by the general formula (CG4) are suitably used.

<Electron transferring material>

Examples of the electron transferring material include compounds represented by the following general formulas (ET1) to (ET17):

(ET1)

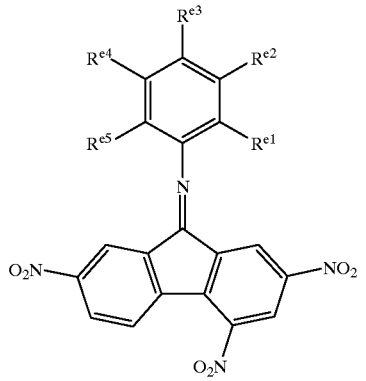

wherein $R^{e1}$, $R^{e2}$, $R^{e3}$, $R^{e4}$ and $R^{e5}$ are the same or different and represent a hydrogen atom, an alkyl group which may have a substituent, an alkoxy group which may have a substituent, an aryl group which may have a substituent, an aralkyl group which may have a substitient, a phenoxy group which may have a substituent, or a halogen atom;

(ET2)

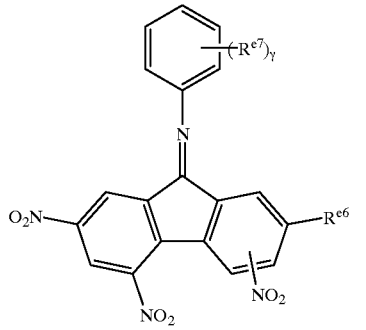

wherein $R^{e6}$ represents an alkyl group; $R^{e7}$ represents an alkyl group which may have a substituent, an alkoxy group which may have a substituent, an aryl group which may have a substituent, an aralkyl group which may have a substitient, a halogen atom or a halogenated alkyl group; and γ represents any one of integers 0 to 5; provided that each $R^{e7}$ may be different when γ is 2 or more;

(ET3)

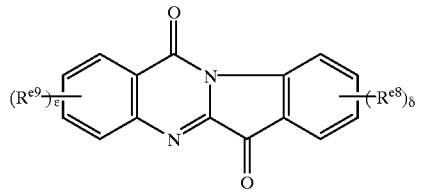

wherein $R^{e8}$ and $R^{e9}$ may be the same or different and represent an alkyl group: δ represents an integer of 1 to 4; and ϵ represents an integer of 0 to 4; provided that each $R^{e8}$ and $R^{e9}$ may be different when δ and ϵ are 2 or more;

(ET4)

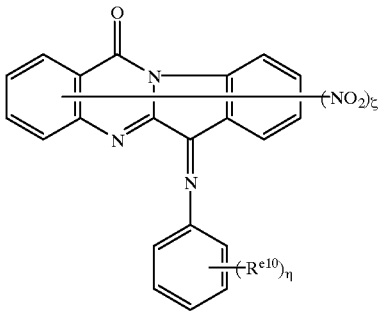

wherein $R^{e10}$ represents an alkyl group, an aryl group, an aralkyl group, an alkoxy group, a halogenated alkyl group or a halogen atom; ζ represents any one of integers 0 to 4; and η represents any one of integers 0 to 5; provided that each $R^{e10}$ may be different when η is 2 or more;

(ET5)

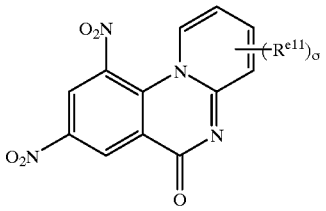

wherein $R^{e11}$ represents an alkyl group; and σ represents any one of integers 1 to 4; provided that each $R^{e11}$ may be different when σ is 2 or more;

(ET6)

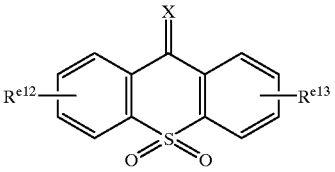

wherein $R^{e12}$ and $R^{e13}$ are the same or different and represent a hydrogen atom, a halogen atom, an alkyl group, an aryl group, an aralkyloxycarbonyl group, an alkoxy group, a hydroxyl group, a nitro group or a cyano group; and X represents an oxygen atom, a ═N—CN group or a $═C(CN)_2$ group;

(ET7)

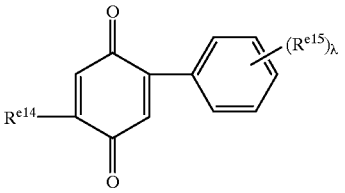

wherein $R^{e14}$ represents a hydrogen atom, a halogen atom, an alkyl group, or a phenyl group which may have a substituent; $R^{e15}$ represents a halogen atom, an alkyl group which may have a substituent, a phenyl group which may have a substituent, an alkoxycarbonyl group, a N-alkylcarbamoyl group, a cyano group or a nitro group; and λ represents any one of integers 0 to 3; provided that each $R^{e15}$ may be different when λ is 2 or more;

(ET8)

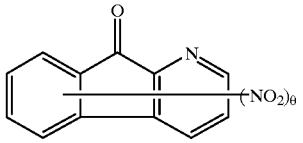

wherein δ represents an integer of 1 to 2;

(ET9)

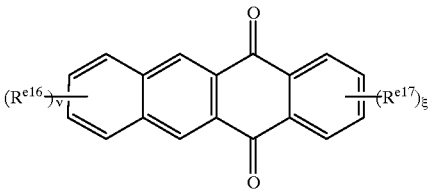

wherein $R^{e16}$ and $R^{e17}$ are the same or different and represent a halogen atom, an alkyl group which may have a substituent, a cyano group, a nitro group or an alkoxycarbonyl group; and ν and ξ, respectively represent any one of integers 0 to 3; provided each $R^{e16}$ and $R^{e17}$ may be different when either of ν or ξ is 2 or more;

(ET10)

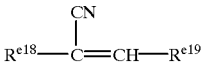

wherein $R^{e18}$ and $R^{e19}$ are the same or different and represent a phenyl group, a polycyclic aromatic group or a heterocyclic group, and these groups may respectively have a substituent;

(ET11)

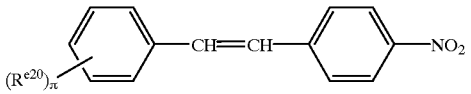

wherein $R^{e20}$ represents an amino group, a dialkylamino group, an alkoxy group, an alkyl group or a phenyl group; and π represents an integer of 1 or 2; provided that each $R^{e20}$ may be different when π is 2;

(ET12)

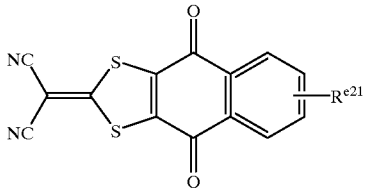

wherein $R^{e21}$ represents a hydrogen atom, an alkyl group, an aryl group, an alkoxy group or an aralkyl group;

(ET13)

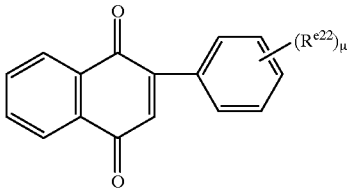

wherein $R^{e22}$ represents a halogen atom, an alkyl group which may have a substituent, a phenyl group which may have a substituent, an alkoxycarbonyl group, a N-alkylcarbamoyl group, a cyano group or a nitro group; and $\mu$ represents any one of integers 0 to 3; provided that each $R^{e22}$ may be different when $\mu$ is 2 or more;

(ET14)

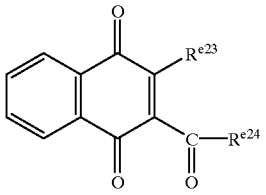

wherein $R^{e23}$ represents an alkyl group which may have a substituent, or an aryl group which may have a substituent; and $R^{e24}$ represents an alkyl group which may have a substituent, an aryl group which may have a substituent, or a group: —O—$R^{e24a}$ ($R^{e24a}$ represents an alkyl group which may have a substituent, or an aryl group which may have a substituent);

(ET15)

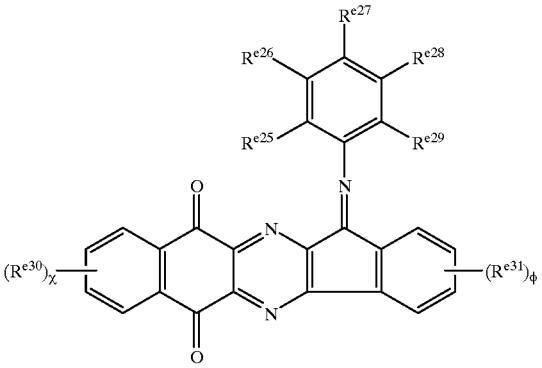

wherein $R^{e25}$, $R^{e26}$, $R^{e27}$, $R^{e28}$, $R^{e29}$, $R^{e30}$ and $R^{e31}$ are the same or different and represent an alkyl group, aryl group, aralkyl group, alkoxy group, a halogen atom or a halogenated alkyl group; and $\chi$ and $\phi$ are the same or different and represent any one of integer 0 to 4;

(ET16)

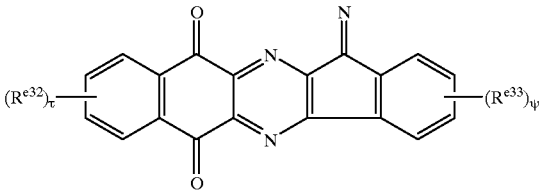

wherein $R^{e32}$ and $R^{e33}$ are the same or different and represent an alkyl group, an aryl group, an alkoxy group, a halogen atom or a halogenated alkyl group; $\tau$ and $\phi$ are the same or different and represent any one of integers 0 to 4; and (ET17)

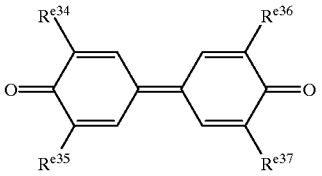

wherein $R^{e34}$, $R^{e35}$ and $R^{e37}$ are the same or different and represent a hydrogen atom, an alkyl group, an alkoly group, an aryl group, an aralkyl group, a cycroalkyl group or an amino group; and two of the groups $R^{e34}$, $R^{e35}$, $R^{e36}$ and $R^{e37}$ are the same group not hydrogen atom.

In the above electron transferring materials, examples of the halogenated alkyl group include those of which alkyl portions are various alkyl groups having 1 to 6 carbon atoms, such as chloromethyl, bromomethyl, fluoromethyl, iodomethyl, 2-chloroethyl, 1-fluoroethyl, 3-chloropropyl, 2-bromopropyl, 1-chloropropyl, 2-chloro-1-methylethyl, 1-bromo-1-methylethyl, 4-iodobutyl, 3-fluorobutyl, 3-chloro-2-methylpropyl, 2-iodo-2-methylpropyl, 1-fluoro-2-methylpropyl, 2-chloro-1, 1-dimethylethyl, 2-bromo-1,1-dimethylethyl, 5-bromopentyl, 4-chlorohexyl and the like.

Examples of the polycyclic aromatic group include naphthyl, penanthryl and anthryl and the like.

Examples of the alkyl group, heterocyclic group, cycloalkyl group, alkoxycarbonyl group and halogen atom include the same groups as those described above.

Examples of the aralkyloxycarbonyl group include those of which aralkyl portions are various aralkyl groups descrived above.

Examples of the N-alkylcarbamoyl group include those of which alkyl portions are various alkyl groups described above.

Examples of the dialkylamino group include those of which alkyl portions are various alkyl groups described above. Two alkyl groups substituted on the amino maybe the same or different.

Examples of the substituent, which may be substituted on the groups described above, include halogen atom, amino group, hydroxyl group, optionally esterified carboxyl group, cyano group, alkyl group having 1 to 6 carbon atoms, alkoxy group having 1 to 6 carbon atoms, alkenyl having 2 to 6 carbon atoms which may have an aryl group, and the like. The substitution position of the substituent is not specifically limited.

Furthermore, there can be used electron transferring materials, with the above-described electron transferring materials (ET1) to (ET17), or inplaceof them, which have hitherto been known, such as benzoquinone compound, malononitrile, thiopyran compound, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, dibromomaleic anhydride, etc., in addition to those described above.

<Hole transferring material>

In the present invention, other hole transferring materials, which have hitherto been known, may be contained in the ptosensitive layer, in addition to the above m-phenylenediamine compound (1) as a hole transferring material. Examples thereof include compounds represented by the following general formulas (HT1) to (HT13):

(HT1)

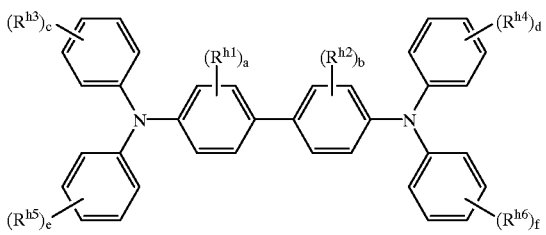

wherein $R^{h1}$, $R^{h2}$, $R^{h3}$, $R^{h4}$, $R^{h5}$ and $R^{h6}$ are the same or different and represent a halogen atom, an alkyl group which may have a substituent, an alkoxy group which may have a substituent, or an aryl group which may have a substituent; a and b are the same or different and represent any one of integers 0 to 4; and c, d, e and f are the same or different and represent any one of integers 0 to 5; provided that each $R^{h1}$, $R^{h2}$, $R^{h3}$, $R^{h4}$, $R^{h5}$ and $R^{h6}$ may be different when a, b, c, d, e or f is 2 or more;

(HT2)

For example, the phenylenediamine compounds include the above m-phenylenediamine compounds (2) and (3), p-phenylenediamine compound and the like except m-phenylenediamine compound (1).

(HT3)

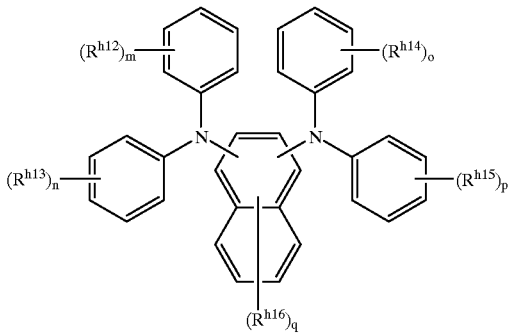

wherein $R^{h12}$, $R^{h13}$, $Rh^{h14}$ and $R^{h15}$ are the same or different and represent a halogen atom, an alkyl group which may have a substituent, an alkoxy group which may have a substituent, or an aryl group which may have a substituent; $R^{h16}$ is a halogen atom, a cyano group, a nitro group, analkyl group whichmay have a substituent, analkoxy group which may have a substituent, or an aryl group which may have a substituent; m, n, o and p are the same or different and represent any one of integers 0 to 5; and q is any one of integers 1 to 6; provided that each $R^{h12}$, $R^{h13}$, $R^{h14}$, $R^{h15}$ and $R^{h16}$ maybe different when m, n, o, p or q is 2 or more;

(HT4)

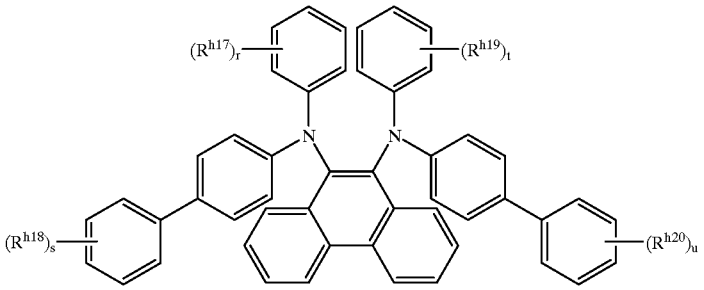

wherein $R^{h17}$, $R^{h18}$, $R^{h19}$ and $R^{h20}$ are the same or different and represent a halogen atom, an alkyl group which may have a substituent, an alkoxy group which may have a substituent, or an aryl group which may have a substituent; r, s, t and u are the same or different and represent any one of integers 0 to 5; provided that each $R^{h17}$, $R^{h18}$, $R^{h19}$ and $R^{h20}$ may be different when r, s, t or u is 2 or more;

(HT5)

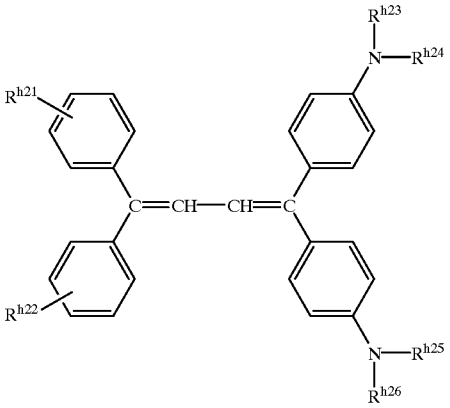

wherein $R^{h21}$ and $R^{h22}$ are the same or different and represent a hydrogen atom, a halogen atom, an alkyl group or an alkoxy group; and $R^{h23}$, $R^{h24}$, $R^{h25}$ and $R^{h26}$ may be same or different and represent a hydrogen atom, an alkyl group or an aryl group;

(HT6)

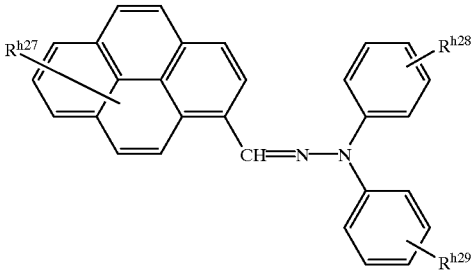

wherein $R^{h27}$, $R^{h28}$ and $R^{h29}$ are the same or different and represent a hydrogen atom, a halogen atom, an alkyl group or an alkoxy group;

(HT7)

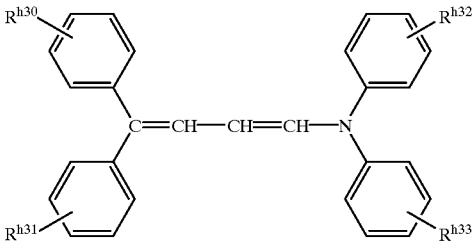

wherein $R^{h30}$, $R^{h31}$, $R^{h32}$ and $R^{h33}$ may be the same or different and represent a hydrogen atom, a halogen atom, an alkyl group or an alkoxy group;

(HT8)

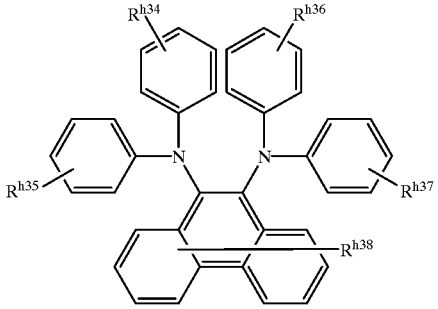

wherein $R^{h34}$, $R^{h35}$, $R^{h36}$, $R^{h37}$ and $R^{h38}$ may be the same or different and represent a hydrogen atom, a halogen atom, an alkyl group or an alkoxy group;

(HT9)

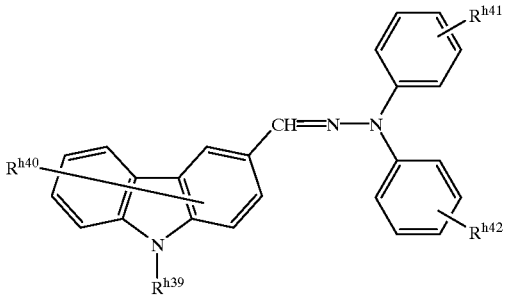

wherein $R^{h39}$ represents a hydrogen atom or an alkyl group; and $R^{h40}$, $R^{h41}$ and $R^{h42}$ may be the same or different and represent a hydrogen atom, a halogen atom, an alkyl group or an alkoxy group;

(HT10)

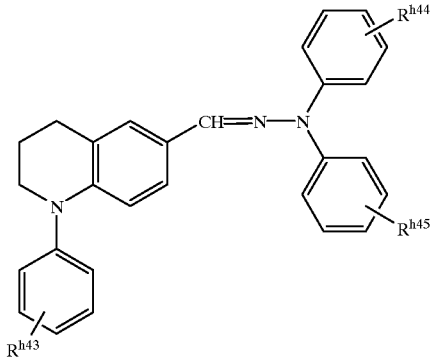

wherein $R^{h43}$, $R^{h44}$ and $R^{h45}$ may be the same or different and represent a hydrogen atom, a halogen atom, an alkyl group or an alkoxy group;

(HT11)

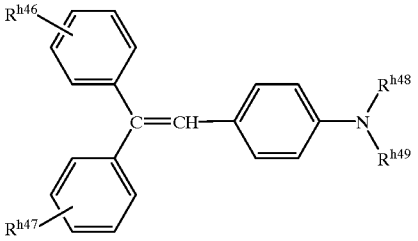

wherein $R^{h46}$ and $R^{h47}$ are the same or different and represent a hydrogen atom, a halogen atom, an alkyl group which may have a substituent, or an alkoxy group which may have a substituent; and $R^{h48}$ and $R^{h49}$ are the same or different and represent a hydrogen atom, an alkyl group which may have a substituent, or an aryl group which may have a substituent;

(HT12)

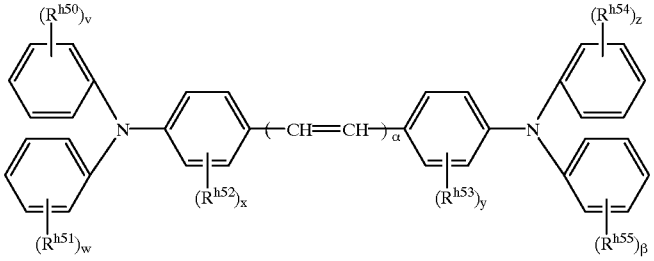

HT-04 wherein $R^{h50}$, $R^{h51}$, $R^{h52}$, $R^{h53}$, $R^{h54}$ and $R^{h55}$ are the same or different and represent an alkyl group which may have a substituent, an alkoxy group which may have a substituent, or an aryl group which may have a substituent; α represents any one of integers 1 to 10; v, w, x, y, z and β are the same or different and represent any one of integers of 0 to 2; provided that each $R^{h50}$, $R^{h51}$, $R^{h52}$, $R^{h53}$, $R^{h54}$ and $R^{h55}$ may be different when either of v, w, x, y, z or β is 2; and (HT13)

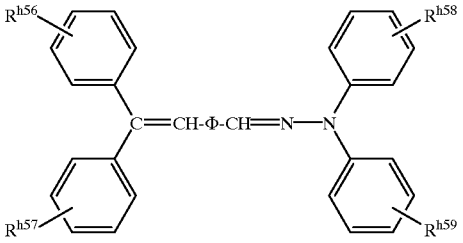

wherein $R^{h56}$, $R^{h57}$, $R^{h58}$ and $R^{h59}$ may be the same or different and represent a hydrogen atom, a halogen atom, an alkyl group or an alkoxy group; and Φ represent any one of groups (Φ-1), (Φ-2) or (Φ-3) respectively represented by the formulas.

(Φ-1)

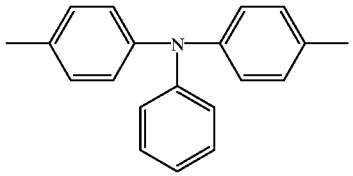

(Φ-2)

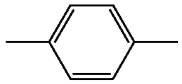

-continued (Φ-3)

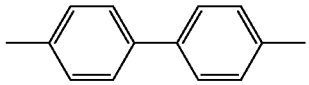

In the hole transferring material as described above, examples of the alkyl group, alkoxy group and halogen atoms include the same groups as those described above.

Examples of the substituents which may be substituted on the groups include halogen atom, amino group, hydroxyl group, optionally esterified carboxyl group, cyano group, alkyl group having 1 to 6 carbon atoms, alkoxy group having 1 to 6 carbon atoms, alkenyl group having 2 to 6 carbon atoms which may have an aryl group, etc. In addition, the substitution position of the substituent are not specifically limited.

Furthermore, there can be used hole transferring materials, with the above-described electron transferring materials (HT1) to (HT13), or in place of them, which have hitherto been known, that is, nitrogen-containing cyclic compounds and condensed polycyclic compounds, e.g. oxadiazole compounds such as 2,5-di(4-methylaminophenyl)-1,3,4-oxadiazole, etc.; styryl compounds such as 9-(4-diethylaminostyryl)anthracene, etc.; carbazole compounds such as polyvinyl carbazole, etc.; organopolysilane compounds; pyrazoline compounds such as 1-phenyl-3-(p-dimethylaminophenyl)pyrazoline, etc.; hydrazone compounds; triphenylamine compounds; indole compounds; oxazole compounds; isoxazole compounds; thiazole compounds; thiadiazole compounds; imidazole compounds; pyrazole compounds; and triazole compounds.

In the present invention, these hole transferring materials may be used alone or in combination thereof. When using the hole transferring material having film forming properties, such as poly(vinylcarbazole), etc., a binding resin is not required necessarily.

<Binding resin>

As the binding resin for dispersing the above respective components, there can be used various resins which have hitherto been used in the photosensitive layer, and examples thereof include thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyarylate, polysulfon, diaryl phthalate resin, ketone resin, polyvinyl butyral resin, polyether resin, polyester resin, etc.; crosslinking thermosetting resins such as silicone resin, epoxy resin, phenol resin, urea resin, melamine resin, etc.; and photosetting resins such as epoxy acrylate, urethane acrylate, etc.

In addition, various additives which have hitherto been known, such as deterioration inhibitors (e.g. antioxidants, radical scavengers, singlet quenchers, ultraviolet absorbers, etc.), softeners, plasticizers, surface modifiers, bulking agents, thickening agents, dispersion stabilizers, wax, acceptors, donors, etc. can be formulated in the photosensitive layer without injury to the electrophotographic characteristics. In order to improve the sensitivity of the photosensitive layer, known sensitizers such as terphenyl, halonaphthoquinones, acenaphthylene, etc. may be used in combination with the electric charge generating material.

A method of producing the electrophotosensitive material of the present invention will be described hereinafter.

A single-layer type electrophotosensitive material, an electric charge generating material, a hole transferring material, a binding resin and an electron transferring material may be dissolved or dispersed in a suitable solvent, and the resulting coating solution is applied on a conductive substrate using means such as application, followed by drying.

In the single-layer type photosensitive material, the electric charge generating material is formulated in the amount of 0.1 to 50 parts by weight, preferably 0.5 to 30 parts by weight, based on 100 parts by weight of the binding resin. The electron transferring material is formulated in the amount of 5 to 100 parts by weight, preferably 10 to 80 parts by weight, based on 100 parts by weight of the binding resin. In addition, the hole transferring material is formulated in the amount of 5 to 500 parts by weight, preferably 25 to 200 parts by weight, based on 100 parts by weight of the binding resin. In a case that the electron transferring material is used with the hole transferring material, it is suitable that the total amount of the hole transferring material and electron transferring material is 10 to 500 parts by weight, preferably 30 to 200 parts by weight, based on 100 parts by weight of the binding resin. When other electron transferring material which has a predetermined redox potential is contained, the amount of the other electron transferring material is 0.1 to 40 parts by weight, preferably 0.5 to 20 parts by weight, based on 100 parts by weight of the binding resin.

The thickness of the single-layer type photosensitive material is 5 to 100 $\mu$m, preferably 10 to 50 $\mu$m.

A multi-layer type electrophotosensitive material, an electric charge generating layer containing an electric charge generating material may be formed on a conductive substrate using means such as deposition, application, etc., and then a coating solution containing an electron transferring material and a binding resin is applied on the electric charge generating layer using means such as application, followed by drying, to form an electric charge transferring layer.

In the multi-layer photosensitive material, the electric charge generating material and binding resin which constitute the electric charge generating layer may be used in various proportions. It is suitable that the electric charge generating material is formulated in the amount of 5 to 1,000 parts by weight, preferably 30 to 500 parts by weight, based on 100 parts by weight of the binding resin. When a hole transferring material is contained in the electric charge generating layer, it is suitable that the hole trasferring material is formulated in the amount of 10 to 500 parts by weight, preferably 50 to 200 parts by weight, based on 100 parts by weight of the binding resin.

The electron transferring material and binding resin, which constitute the electric charge transferring layer, can be used in various proportions within such a range as not to prevent the transfer of electrons and to prevent the crystallization. It is suitable that the electron transferring material is used in the amount of 10 to 500 parts by weight, preferably 25 to 100 parts by weight, based on 100 parts by weight of the binding resin so as to easily transfer electrons generated by light irradiation in the electric charge generating layer. When the other electron trasferring material which has a predetermined redox potential is contained, the amount of the other electron trasferring material is 0.1 to 40 parts by weight, preferably 0.5 to 20 parts by weight of the binding resin.

Regarding the thickness of the multi-layer type photosensitive layer, the thickness of the electric charge generating layer is about 0.01 to 5 $\mu$m, preferably about 0.1 to 3 $\mu$m, and that of the electric charge transferring layer is 2 to 100 $\mu$m, preferably about 5 to 50 $\mu$m.

A barrier layer may be formed, in such a range as not to injure the characteristics of the photosensitive material, between the conductive substrate and photosensitive layer in the single-layer type photosensitive material, or between the conductive substrate and electric charge generating layer or between the conductive substrate layer and electric charge transferring layer in the multi-layer type photosensitive material. Further, a protective layer may be formed on the surface of the photosensitive layer.

As the conductive substrate to be used in the electrophotosensitive material of the present invention, various materials having the conductivity can be used, and examples thereof include single metals such as iron aluminum, copper, tin, platinum, silver, vanadium, molybdenum, chromium, cadmium, titanium, nickel, palladium, indium, stainless steel, brass, etc.; plastic materials which are vapor-deposited or laminated with the above metal; glass materials coated with aluminum iodide, tin oxide, indium oxide, etc.

The conductive substrate may be made in the form of a sheet or a drum to the construction of image forming apparatuses. The substrate itself may have a conductivity or only the surface of the substrate may have a conductivity. It is preferred that the conductive substrate has sufficient mechanical strength when used.

The photosensitive layer is produced by applying a dispersing (coating) solution, obtained by dissolving or dispersing a resin composition containing the above respective components in a suitable solvent, on a conductive substrate, followed by drying.

That is, the above electric charge generating material, electric charge transferring material and binding resin may be dispersed and mixed with a suitable solvent by a known method, for example, using a roll mill, a ball mill, an atriter, a paint shaker, a supersonic dispenser, etc. to prepare a dispersion, which is applied by a known means and then allowed to dry.

As the solvent for preparing the dispersing solution, there can be used various organic solvents, and examples thereof include alcohols such as methanol, ethanol, isopropanol, butanol, etc., aliphatic hydrocarbons such as n-hexane, octane, cyclohexane, etc.; aromatic hydrocarbons such as benzene, toluene, xylene, etc.; halogenated hydrocarbons such as dichloromethane, dichloroethane, chloroform, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde, dimethylformamide, dimethyl sulfoxide, etc. These solvents may be used alone or in combination thereof.

In order to improve a dispersibility of the electric charge transferring material and electric charge generating material as well as a smoothness of the surface of the photosensitive layer, there may be used surfactants, leveling agents, etc.

The image forming method of the present invention will be described hereinafter.

The image forming method of the present invention comprises the steps of uniformly charging the surface of the above electrophotosensitive material of the present invention, and exposing to light under the conditions of a light exposure of not more than 0.54 mw/cm$^2$ and an exposure time of not more than 25 msec to form an electrostatic latent image on the surface, as described previously.

The electrostatic latent image formed on the surface of the electrophotosensitive material is picturizing according to general method to form a toner image, transferred on the surface of a material for transfer such as paper and then fixed on the above transfer material by means of heating or pressurizing. The electrophotosensitive material on which the toner image has been transferred is used for the subsequent image formation after removing the residual toner on the surface using a cleaning blade.

According to such an image forming method of the present invention, since the electrophotosensitive material of the present invention has high sensitivity which has never been accomplished as described above, it becomes possible to form a good image having a sufficient image concentration even under the exposure conditions capable of realizing higher speed and energy saving wherein the exposure dose is not more than 0.54 mW/cm$^2$ and the exposure time is not more than 25 msec.

The light exposure is determined as follows in the practical image forming device. For example, as shown in FIG. 1, exposure is performed in the state where a light receiving portion of a light detector 3 [e.g. Optical Block TQ82021, manufactured by Advantest Co., Ltd.] is located at the position of the center of an electrophotosensitive material 1 in a width direction out of the portion (indicated by a two-dot chain line in the drawing) to be exposed to light from a light source 2 on the surface of the electrophotosensitive material 1, that is, the position of a perpendicular (indicated by a one-dot chain line in the drawing) from the light source 2 on the electrophotosensitive material 1, and then the measured value is analyzed by using a analyzer 4 [e.g. Optical Power Meter TQ8215, manufactured by Advantest Co., Ltd.], thereby to obtain a light exposure.

The exposure time is determined from an exposure width in the circumferential direction of the surface of the electrophotosensitive material 1 due to the light source 2, and a rotational rate of said electrophotosensitive material 1.

As described in detail hereinabove, the present invention can exert a specific working effect capable of providing an electrophotosensitive material which has a photosensitive layer not only having particularly high sensitivity and being able to sufficiently cope with the requirements such as realization of much higher speed and much larger energy saving of the image forming device, but also having excellent stability to strong light, durability and heat resistance, and an image forming method using the same, capable of realizing much higher speed and much larger energy saving.

EXAMPLES

The following Examples further illustrate the present invention in detail.

<Electropotosensitive material for analogue light source (single-layer type)>

Example 1

5 Parts by weight of a bisazo pigment represented by the formula (CG4-1):

(CG4-1)

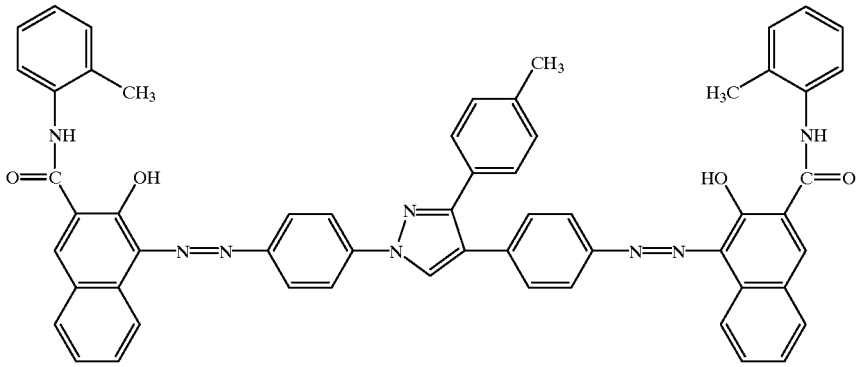

as the electric charge generating material, 100 parts by weight of a m-phenylenediamine compound represented by the formula (1-1)

(1-1)

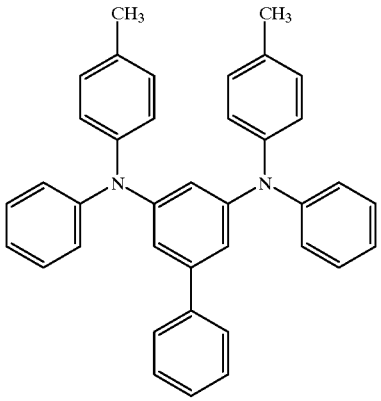

as the hole transferring material and 100 parts by weight of poly(4,4"-cyclohexylidenediphenyi)carbonate as the binding resin were mixed and dispersed, together with a predetermined amount of tetrahydrofuran, by using an ultrasonic dispersion mixer to prepare a coating solution for single-layer type photosensitive layer.

Then, this coating solution was applied on an aluminum tube having an outer diameter of 78 mm and a length of 340 mm as the conductive substrate by using a dip coating method, followed by hot-air drying in a dark place at 100° C. for 30 minutes to obtain a drum type electrophotosensitive material for analogue light source, which has a single-layer type photosensitive layer of 24 $\mu$m in film thickness.

Example 2

According to the same manner as that described in Example 1 except for using 100 parts by weight of a m-phenylenediamine compound represented by the formula (1-2):

(1-2)

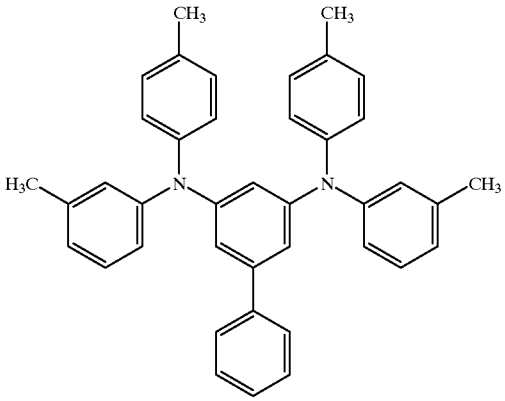

as the hole transferring material, a drum type electrophotosensitive material for analogue light source, which has a single-layer type photosensitive layer, was produced.

Example 3

According to the same manner as that described in Example 1 except for using 100 parts by weight of a m-phenylenediamine compound represented by the formula (1-3):

(1-3)

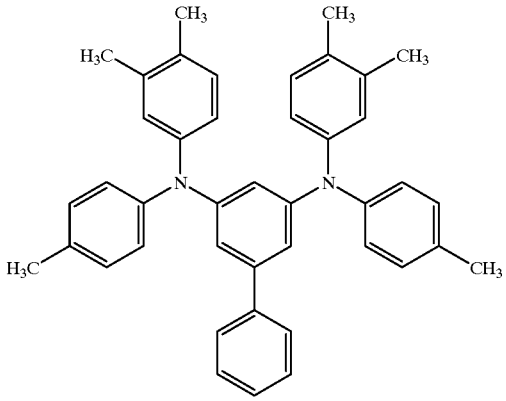

as the hole transferring material, a drum type electrophotosensitive material for analogue light source, which has a single-layer type photosensitive layer, was produced.

Example 4

According to the same manner as that described in Example 1 except for using 100 parts by weight of a m-phenylenediamine compound represented by the formula (1-4):

(1-4)

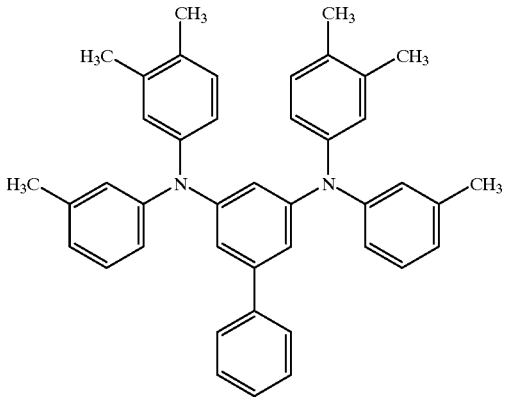

as the hole transferring material, a drum type electrophotosensitive material for analogue light source, which has a single-layer type photosensitive layer, was produced.

Example 5

According to the same manner as that described in Example 1 except for using 100 parts by weight of a m-phenylenediamine compound represented by the formula (1-5):

(1-5)

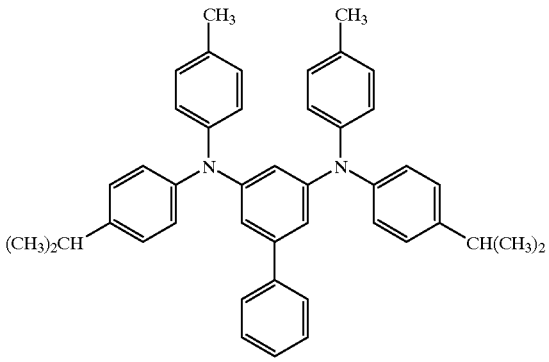

as the hole transferring material, a drum type electrophotosensitive material for analogue light source, which has a single-layer type photosensitive layer, was produced.

Example 6

According to the same manner as that described in Example 1 except for using 100 parts by weight of a m-phenylenediamine compound represented by the formula (1-6):

(1-6)

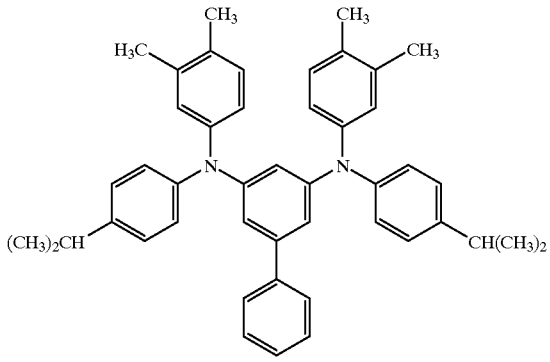

as the hole transferring material, a drum type electrophotosensitive material for analogue light source, which has a single-layer type photosensitive layer, was produced.

Example 7

According to the same manner as that described in Example 1 except for using 100 parts by weight of a m-phenylenediamine compound represented by the formula (1-7):

(1-7)

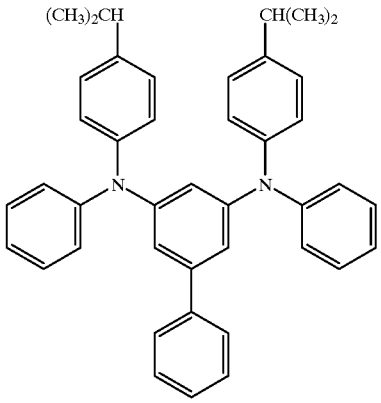

as the hole transferring material, a drum type electrophotosensitive material for analogue light source, which has a single-layer type photosensitive layer, was produced.

Example 8

According to the same manner as that described in Example 1 except for using 100 parts by weight of a m-phenylenediamine compound represented by the formula (1-8):

(1-8)

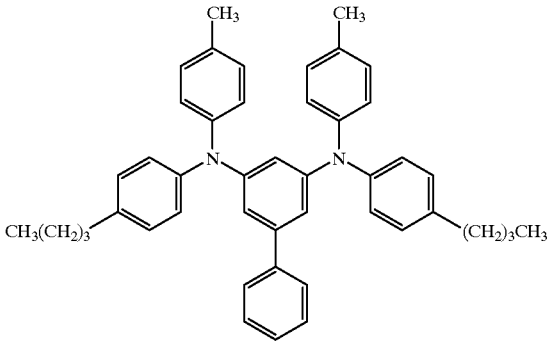

as the hole transferring material, a drum type electrophotosensitive material for analogue light source, which has a single-layer type photosensitive layer, was produced.

Example 9

According to the same manner as that described in Example 1 except for using 100 parts by weight of a m-phenylenediamine compound represented by the formula (1-9):

(1-9)

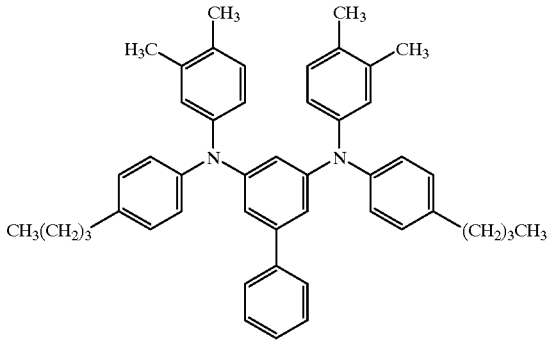

as the hole transferring material, a drum type electrophotosensitive material for analogue light source, which has a single-layer type photosensitive layer, was produced.

Example 10

According to the same manner as that described in Example 1 except for using 100 parts by weight of a m-phenylenediamine compound represented by the formula (1-10):

(1-10)

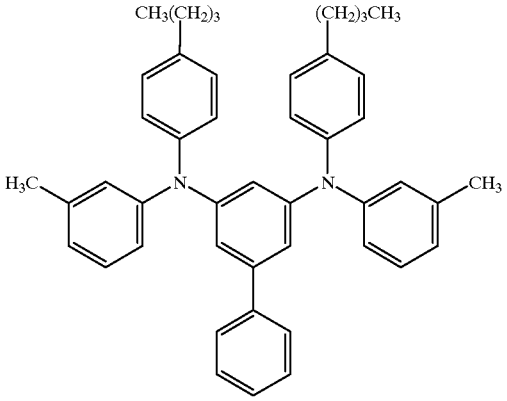

as the hole transferring material, a drum type electrophotosensitive material for analogue light source, which has a single-layer type photosensitive layer, was produced.

Example 11

According to the same manner as that described in Example 1 except for using 100 parts by weight of a m-phenylenediamine compound represented by the formula (1-11):

(1-11)

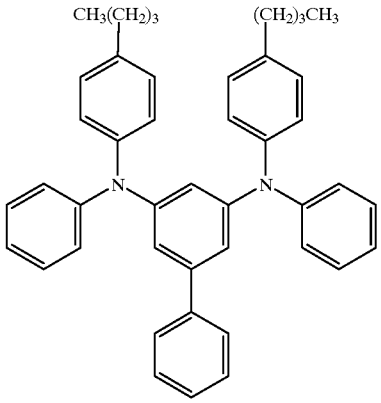

as the hole transferring material, a drum type electrophotosensitive material for analogue light source, which has a single-layer type photosensitive layer, was produced.

Comparative Example 1

According to the same manner as that described in Example 1 except for using 100 parts by weight of a m-phenylenediamine compound represented by the formula (3-1):

(3-1)

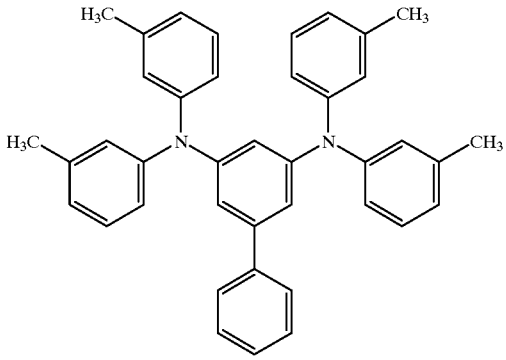

which belongs to the compound of the fourth Synthesis Example of the publication of the prior application among the conventional m-phenylenediamine compound (3) as the hole transferring material, a drum type electrophotosensitive material for analogue light source, which has a single-layer type photosensitive layer, was produced.

Comparative Example 2

According to the same manner as that described in Example 1 except for using 100 parts by weight of a m-phenylenediamine compound represented by the formula (4):

(4)

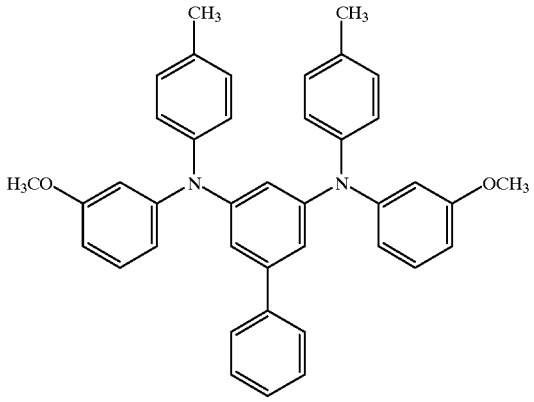

wherein the outer phenyl group is substitute with a methoxy group which is a substituent other than a hydrogen atom and an alkyl group defined in the present invention, as the hole transferring material, adrumtype electrophotosensitive material for analogue light source, which has a single-layer type photosensitive layer, was produced.

Comparative Example 3

According to the same manner as that described in Example 1 except for using 100 parts by weight of a m-phenylenediamine compound represented by the formula (2-1):

(2-1)

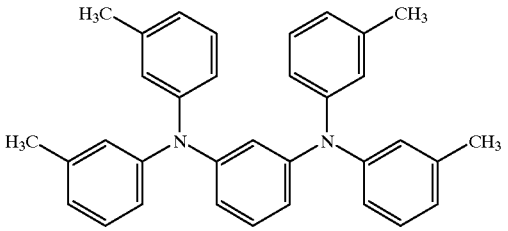

which belongs to the conventional m-phenylenediamine compound (2) as the hole transferring material, a drum type electrophotosensitive material for analogue light source, which has a single-layer type photosensitive layer, was produced.

Comparative Example 4

According to the same manner as that described in Example 1 except for using 100 parts by weight of a m-phenylenediamine compound represented by the formula (2-2):

(2-2)

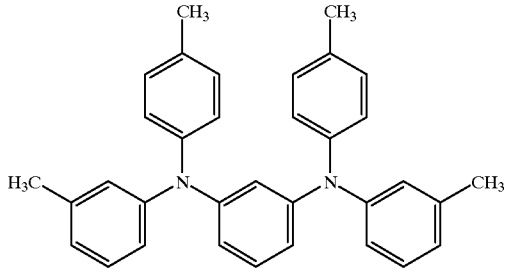

which belongs to the conventional m-phenylenediamine compound (2) as the hole transferring material, a drum type electrophotosensitive material for analogue light source, which has a single-layer type photosensitive layer, was produced.

Comparative Example 5

According to the same manner as that described in Example 1 except for using 100 parts by weight of a m-phenylenediamine compound represented by the formula (2-3):

(2-3)

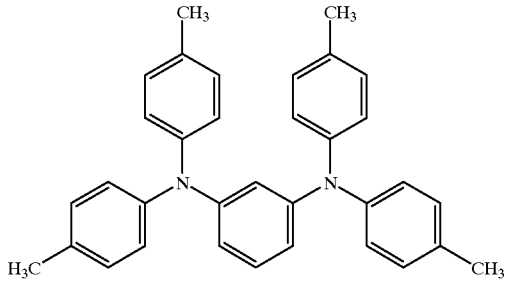

which belongs to the conventional m-phenylenediamine compound (2) as the hole transferring material, a drum type electrophotosensitive material for analogue light source, which has a single-layer type photosensitive layer, was produced.

Comparative Example 6

According to the same manner as that described in Example 1 except for using 100 parts by weight of a m-phenylenediamine compound represented by the formula (5):

(5)

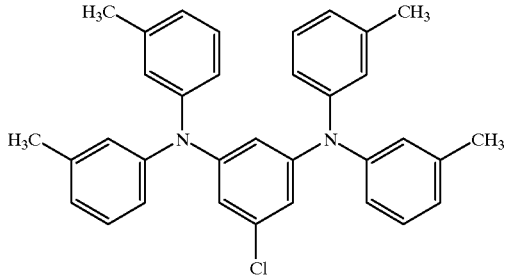

wherein a chlorine atom which is a group other than that defined in the publication of the prior application is substituted on the 5-position of the central benzene ring, as the hole transferring material, a drumtype electrophotosensitive material for analogue light source, which has a single-layer type photosensitive layer, was produced.

The electrophotosensitive materials of the above respective Examples and Comparative Examples were subjected to the following respective tests, and their characteristics were evaluated.

Photosensitivity Test I

Using a drum sensitivity tester (GENTEC SINSIA 30 M) manufactured by GENTEC Co., a voltage was applied to the electrophotosensitive material of the respective Examples and Comparative Examples to charge the surface at +800 V.

Then, the above electrophotosensitive material in the charged state was exposed (exposure time: 25 msec) by irradiating white light (light exposure: 0.54mW/cm$^2$) from a halogen lamp which is a light source of the above mentioned test machine on the surface.

Then, a surface potential at the time at which 0.15 seconds has passed since the beginning of exposure was measured as a residual potential Vrp1 (V).

The above exposure condition corresponds to an exposure condition in a high-speed image forming device wherein an image forming speed is 40 copies per minute as double as that of a current model. The lower the residual potential becomes, the higher the sensitivity of the electrophotosensitive material.

High-temperature Light Resistance Test

Under the environmental conditions of 50° C., white light with 4,000 lux from a white fluorescent lamp was irradiated on the electrophotosensitive materials of the respective Examples and Comparative Examples for 20 minutes. After the electrophotosensitive materials were allowed to stand in a dark place for 30 minutes, thereby cooling to a normal temperature, the residual potential was measured again under the same conditions by using the same drum sensitivity tester as that described above.

Then, a difference ΔVrp1 between the residual potentials before and after light irradiation was determined and the stability at high temperature to strong light, that is, high-temperature light resistance was evaluated.

The smaller the difference ΔVrp1 becomes, the better the high-temperature light resistance of the electrophotosensitive material.

Measurement of Glass Transition Temperature

Each photosensitive layer of the electrophotosensitive materials of the respective Examples and Comparative Examples was peeled off in the form of a film (about 5 mg), put in an aluminum pun and then sealed to obtain a sample. With respect to this sample, the glass transition temperature [Tig (extrapolated glass transition initiation temperature C.), JIS K7121] of the photosensitive layer was measured under the conditions (atmos-pheric gas: air, heating rate: 20° C./min.) using a differential scanning calorimeter (DSC) device [DSC8230D, manufactured by Rigaku Denki Co., Ltd.].

High-temperature Durability Test

The coating solution for single-layer type photosensitive layer prepared in the respective Examples and Comparative Examples was applied on an aluminum tube having an outer diameter of 30 mm and a length of 346 mm as the conductive substrate by using a dip coating method, followed by hot-air drying in a dark place at 100° C. for 30 minutes to obtain a drum type electrophotosensitive material for analogue light source, which has a single-layer type photosensitive layer of 24 μm in film thickness, used for high-temperature durability test.

Then, each electrophotosensitive material was mounted in a drum unit for an electrostatic copying machine [DC-2355, manufactured by Mita Industries Co., Ltd.] and was stored in an oven at 50° C. for a week in the state where a cleaning blade is always contacted with the surface. The linear pressure in case of pressing the cleaning blade was 30 N/cm$^2$.

Then, this drum unit was mounted in the above electrostatic copying machine and copying of a gray scale image was performed.

The formed image was visually observed and evaluated by the following criteria. bad: High-temperature durability is poor because an black stripe is appeared on the formed image, that is an impression due to a cleaning blade appeared as a stripe which was caused by concave portion on the surface of the photosensitive layer. good: High-temperature durability is good because no black stripe is observed on the formed image, that is, any deformation due to pressing of a cleaning blade did not occur.

The above results are shown in Table 2.

TABLE 2

| | Compound No. | Vrp1 (V) | ΔVrp1 (V) | Tig (° C.) | High-temperature durability |
|---|---|---|---|---|---|
| Ex. 1 | 1–1 | 230 | +5 | 72.4 | Good |
| Ex. 2 | 1–2 | 230 | +5 | 71.0 | Good |
| Ex. 3 | 1–3 | 219 | +18 | 73.6 | Good |
| Ex. 4 | 1–4 | 224 | +12 | 70.5 | Good |
| Ex. 5 | 1–5 | 204 | +16 | 71.0 | Good |
| Ex. 6 | 1–6 | 220 | +15 | 73.6 | Good |
| Ex. 7 | 1–7 | 236 | +15 | 71.5 | Good |
| Ex. 8 | 1–8 | 201 | +10 | 70.0 | Good |
| Ex. 9 | 1–9 | 216 | +15 | 70.6 | Good |
| Ex. 10 | 1–10 | 220 | +8 | 70.0 | Good |
| Ex. 11 | 1–11 | 226 | +13 | 71.0 | Good |
| Com. Ex. 1 | 3–1 | 269 | +13 | 71.0 | Good |
| Com. Ex. 2 | 4 | 265 | +12 | 73.0 | Good |
| Com. Ex. 3 | 2–1 | 250 | +68 | 62.0 | Bad |
| Com. Ex. 4 | 2–2 | 248 | — | — | — |
| Com. Ex. 5 | 2–3 | 222 | — | — | — |
| Com. Ex. 6 | 5 | 250 | +49 | 61.0 | Bad |

As is apparent from Table 2, both of an electrophotosensitive material using a compound of the formula (3-1) belonging to a conventional m-phenylenediamine compound (3) as the hole transferring material of Comparative Example 1 and an electrophotosensitive material using a compound of the formula (4) of Comparative Example 2, which is similar to a m-phenylenediamine compound (1) in the present invention but is different in kind of substituents have a same results as those of the respective Examples of the present invention with respect to the stability to strong light, durability and heat resistance, however, the initial sensitivity is insufficient.

An electrophotosensitive material using a compound of the formula (2-1) belonging to a conventional m-pphenyllenediammine compound (2) as the hole transferring material of Comparative Example 3 and an electrophotosensitive material using a compound of the formula (S) corresponding to a compound obtained by substituting a chlorine atom on the 5-position of the central benzene ring of the compound of the formula (2-1) of Comparative Example 6 showed low initial sensitivity and, furthermore, the stability to strong light, durability and heat resistance were insufficient.

An electrophotosensitive material using a compound of the formula (2-2) of Comparative Example 4 showed low initial sensitivity. Furthermore, since the compound was slightly crystallized in the photosensitive layer, we abandoned other tests.

Regarding an electrophotosensitive material using a compound of the formula (2-3) of Comparative Example 5, the initial sensitivity was improved but the compound was crystallized in the photosensitive layer. Therefore, we abandoned other tests.

On the other hand, it has been found that electrophotosensitive materials using a m-phenylenediamine compound of the formula (1) of Examples 1 to 11 of the present invention have high initial sensitivity and are superior in stability to strong light, durability and heat resistance.

It has been confirmed that even an electrophotosensitive material of Example 7 wherein the initial sensitivity is the lowest, that is, the initial residual potential Vrp1 is the highest, the residual potential Vrp1 is 33 V lower than that of the electrophotosensitive material of Comparative Example 1 which corresponds to the construction of the prior art and the sensitivity is very high. That is, a difference in residual potential is close to an increase in residual potential in case that a continuous image formation (1,000,000 copies close to a life of the electrophotosensitive material) is performed using an electrophotosensitive material of Example 7. As is apparent from this fact, the electrophotosensitive material of the present invention has higher sensitivity than that of the prior art.

As a result of a comparison between the electrophotosensitive materials of the above respective Examples, it has been confirmed that electrophotosensitive materials using compounds wherein the groups $R^{1A}$ and $R^{1B}$ are respectively an alkyl group having 1 to 4 carbon atoms, the groups $R^{1F}$ and $R^{1G}$ are respectively an alkyl group having 1 to 4 carbon atoms substitute on the 3- or 4-position of a phenyl group and the groups $R^{1D}$ and $R^{1E}$ are respectively a hydrogen atom among the m-phenylenediamine compound (1), particularly compounds of the formulas (1-2), (1-5), (1-8) and (1-10) wherein the alkyl group corresponding to the groups $R^{1A}$, $R^{1B}$, $R^{1C}$ and $R^{1F}$ is methyl, isopropyl or normal group of Examples 2, 5, 8 and 10 are generally superior in initial sensitivity, stability to strong light, durability and heat resistance.

Photosensitivity Test II

Using the above-described drum sensitivity tester (GENTEC SINSIA 30 M) manufactured by GENTEC Co., a voltage was applied to each of the electrophotosensitive materials of Example 2 and Comparative Example 1 among the respective Examples and Comparative Examples to charge the surface at +800 V.

Then, the above electrophotosensitive material with the charged state was exposed (exposure time: 25 msec) by irradiating white light (light exposure: 0.92 mW/cm$^2$) from a halogen lamp as an exposure light source of the above tester on the surface.

Then, a surface potential at the time at which 0.15 seconds has passed since the beginning of exposure was measured as a residual potential Vrp2 (V).

The above exposure condition corresponds to an exposure condition in an image forming speed wherein an image forming rate is 20 copies per minute of a current model. The lower the residual potential Vrp2 becomes, the higher the sensitivity of the electrophotosensitive material.

The above results are shown in Table 3, together with the results of the above-described photosensitivity test I.

TABLE 3

| | Vrp1 (V) | Vrp2 (V) |
|---|---|---|
| Ex. 2 | 230 | 99 |
| Com. Ex. 1 | 269 | 100 |

As is apparent from Table 3, a clear difference in sensitivity between the electrophotosensitive material of Example 2 of the present invention and a conventional electrophotosensitive material of Comparative Example 1 is not recognized in case of an image forming rate closer to that of a current model, however, a difference in sensitivity appears with an increase of the image forming speed, that is, high sensitivity is attained.

Consequently, it has been confirmed that the electrophotosensitive material of the present invention has sufficient sensitivity even if it is used in an image forming device capable of realizing higher speed and energy saving wherein an exposure dose is not more than 0.54 mW/cm$^2$ and an exposure time is not more than 25 msec.

This application claims priority benefits of Japanese Patent Appliaction No. 9-358633 filed on Dec. 25, 1997 under 35 USC 119, the disclosure thereof being incorporated herein by reference.

What is claimed is:

1. An electrophotosensitive material comprising a single-layer photosensitive layer containing a charge generating material and a m-phenylenediamine compound represented by the general formula (1):

(1)

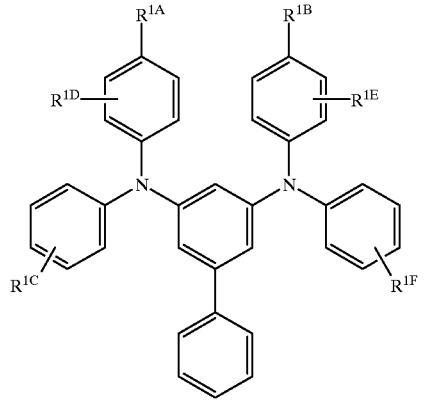

wherein $R^{1A}$ and $R^{1B}$ are the same or different and indicate an alkyl group; and $R^{1C}$, $R^{1D}$, $R^{1E}$ and $R^{1F}$ are the same or different and indicate a hydrogen atom or an alkyl group.

2. The electrophotosensitive material according to claim 1, which is used in an image forming device wherein an light exposure to the electrophotosensitive material is not more than 0.54 mW/cm$^2$ and an exposure time is not more than 25 msec.

3. The electrophotosensitive material according to claim 1, wherein the groups $R^{1A}$ and $R^{1B}$ in the general formula (1) are respectively an alkyl group having 1 to 4 carbon atoms, the groups $R^{1C}$ and $R^{1F}$ are respectively an alkyl group having 1 to 4 carbon atoms substituted on the 3- or 4-position of a phenyl group, and the groups $R^{1D}$ and $R^{1E}$ are respectively a hydrogen atom.

4. The electrophotosensitive material according to claim 3, wherein the alkyl group corresponding to the groups $R^{1A}$, $R^{1B}$, $R^{1C}$ and $R^{1F}$ is methyl, isopropyl or normal butyl.

5. The electrophotosensitive material according to claim 1, wherein the m-phenylenediamine compound contained in the photosensitive layer is a compound represented by the formula (1-2):

(1-2)

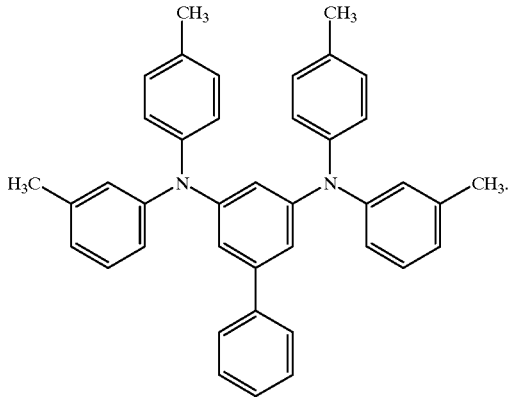

6. The electrophotosensitive material according to claim 1, wherein the m-phenylenediamine compound contained in the photosensitive layer is a compound represented by the formula (1-5):

(1-5)

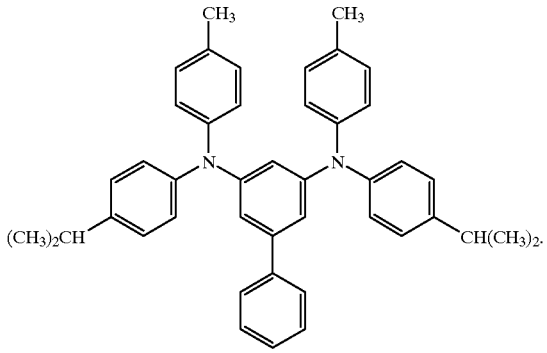

7. The electrophotosensitive material according to claim 1, wherein the m-phenylenediamine compound contained in the photosensitive layer is a compound represented by the formula (1-8):

(1-8)

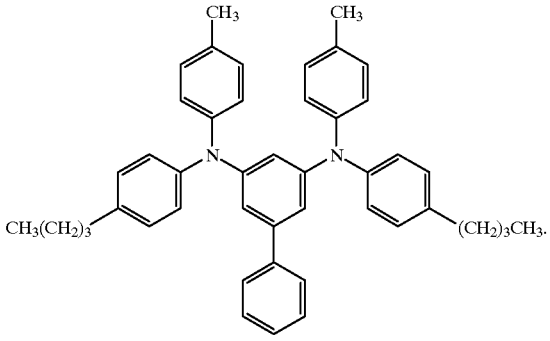

8. The electrophotosensitive material according to claim 1, wherein the m-phenylenediamine compound contained in the photosensitive layer is a compound represented by the formula (1-10):

(1-10)

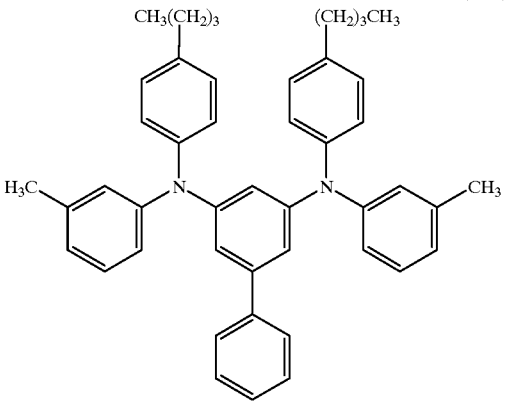

9. An image forming method, which comprises the steps of uniformly charging the surface of an electrophotosensitive material comprising a single-layer photosensitive layer containing a charge generating material and a m-phenylenediamine compound represented by the general formula (1):

(1)

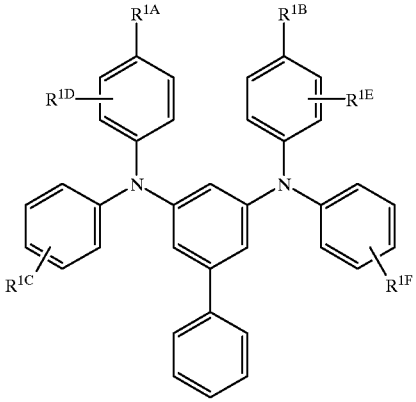

wherein $R^{1A}$ and $R^{1B}$ are the same or different and indicate an alkyl group; and $R^{1C}$, $R^{1D}$, $R^{1E}$ and $R^{1F}$ are the same or different and represent a hydrogen atom or an alkyl group, and exposing to light under the conditions of an light exposure of not more than 0.54 mW/cm$^2$ and an exposure time of not more than 25 msec to form an electrostatic latent image on the surface.

10. The image forming method according to claim 9, further comprising the steps of developing the electrostatic latent image formed on the surface of the electrophotosensitive material with a developer containing at least a toner, thereby picturizing the electrostatic latentimage to form a toner image, transferring the toner image on the surface of a transfer material, and fixing the toner image.

* * * * *